US010107514B2

(12) United States Patent
Yamashita

(10) Patent No.: US 10,107,514 B2
(45) Date of Patent: Oct. 23, 2018

(54) AIR-CONDITIONING APPARATUS INCLUDING MULTIPLE EXPANSION DEVICES

(71) Applicant: Mitsubishi Electric Corporation, Tokyo (JP)

(72) Inventor: Koji Yamashita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 322 days.

(21) Appl. No.: 14/898,508

(22) PCT Filed: Aug. 28, 2013

(86) PCT No.: PCT/JP2013/072993
§ 371 (c)(1),
(2) Date: Dec. 15, 2015

(87) PCT Pub. No.: WO2015/029160
PCT Pub. Date: Mar. 5, 2015

(65) Prior Publication Data

US 2016/0146496 A1 May 26, 2016

(51) Int. Cl.
*F24F 1/46* (2011.01)
*F24F 11/00* (2018.01)
(Continued)

(52) U.S. Cl.
CPC ..... *F24F 11/008* (2013.01); *F24F 1/0003* (2013.01); *F24F 1/46* (2013.01);
(Continued)

(58) Field of Classification Search
CPC ..... F25B 9/006; F25B 2341/0662; F25B 2700/191; F25B 2313/0291;
(Continued)

(56) References Cited

U.S. PATENT DOCUMENTS 4,106,306 A * 8/1978 Saunders ..... F25B 45/00 62/149
4,208,886 A * 6/1980 Maudlin ..... F25B 1/00 62/498
(Continued)

FOREIGN PATENT DOCUMENTS

JP 62-189568 U 12/1987
JP H02-298769 A 12/1990
(Continued)

OTHER PUBLICATIONS

Extended European Search Report dated Feb. 24, 2017 in the corresponding EP patent application No. 13892612.6.
(Continued)

*Primary Examiner* — Frantz Jules
*Assistant Examiner* — Nelson Nieves
(74) *Attorney, Agent, or Firm* — Posz Law Group, PLC

(57) ABSTRACT

An air-conditioning apparatus includes a refrigerant circuit connecting a compressor, a first heat exchanger, a first expansion device, and a second heat exchanger. The compressor and the first heat exchanger are housed in a heat source unit, the heat source unit, houses a second expansion device provided at a location on a downstream side with respect to the first heat exchanger and on an upstream side with respect to the first expansion device, and the second expansion device and the first expansion device are connected via an extension pipe. The second expansion device reduces a pressure of refrigerant flowing into the extension pipe in cooling operation to cause the refrigerant to turn into refrigerant having a medium pressure and in a two-phase state, and the medium pressure is lower than a refrigerant pressure in a condenser and higher than a refrigerant pressure in an evaporator.

9 Claims, 9 Drawing Sheets

(51) Int. Cl.

| | |
|---|---|
| ***F25B 13/00*** | (2006.01) |
| ***F25B 49/02*** | (2006.01) |
| ***F24F 1/00*** | (2011.01) |
| ***F24F 13/30*** | (2006.01) |
| ***F25B 9/00*** | (2006.01) |
| ***F24F 11/83*** | (2018.01) |
| *F24F 11/84* | (2018.01) |

(52) U.S. Cl.
CPC ..... *F24F 11/83* (2018.01); *F24F 13/30* (2013.01); *F25B 9/006* (2013.01); *F25B 13/00* (2013.01); *F25B 49/02* (2013.01); *F24F 11/84* (2018.01); *F25B 2313/003* (2013.01); *F25B 2313/029* (2013.01); *F25B 2313/0233* (2013.01); *F25B 2313/0272* (2013.01); *F25B 2313/02791* (2013.01); *F25B 2313/0313* (2013.01); *F25B 2313/0314* (2013.01); *F25B 2313/0315* (2013.01); *F25B 2600/025* (2013.01); *F25B 2600/11* (2013.01); *F25B 2600/2507* (2013.01); *F25B 2600/2513* (2013.01); *F25B 2700/1931* (2013.01); *F25B 2700/1933* (2013.01); *F25B 2700/21152* (2013.01)

(58) Field of Classification Search
CPC ..... F25B 2700/1931; F25B 2700/1933; F25B 2600/025; F25B 2313/0315; F25B 2313/0313; F25B 2600/11; F24F 1/0003; F24F 1/46; F24F 13/30; F24F 11/84
See application file for complete search history.

(56) References Cited

U.S. PATENT DOCUMENTS

| | | | | |
|---|---|---|---|---|
| 6,053,000 | A * | 4/2000 | Levitin | F25B 41/062 62/205 |
| 8,635,879 | B2 * | 1/2014 | Ryu | F25B 40/02 62/196.1 |
| 2001/0027657 | A1 * | 10/2001 | Yamasaki | F25B 41/06 62/222 |
| 2006/0266057 | A1 * | 11/2006 | Yakumaru | F25B 9/008 62/160 |
| 2008/0022706 | A1 * | 1/2008 | Sakimichi | F25B 1/10 62/190 |
| 2009/0025420 | A1 * | 1/2009 | Kojima | F24F 1/0059 62/527 |
| 2009/0158771 | A1 * | 6/2009 | Low | C08J 9/146 62/498 |
| 2010/0037647 | A1 * | 2/2010 | Kurihara | F25B 9/008 62/434 |
| 2010/0050672 | A1 * | 3/2010 | Kurihara | F25B 9/008 62/190 |
| 2010/0175400 | A1 * | 7/2010 | Kasahara | F25B 1/10 62/225 |
| 2011/0185756 | A1 * | 8/2011 | Yamashita | F24F 3/06 62/171 |
| 2011/0219794 | A1 * | 9/2011 | Shiba | F25B 45/00 62/125 |
| 2012/0042674 | A1 * | 2/2012 | Takenaka | F24F 3/06 62/180 |
| 2012/0043054 | A1 * | 2/2012 | Shimazu | F25B 13/00 165/58 |
| 2012/0125025 | A1 * | 5/2012 | Ishizeki | F25B 49/022 62/126 |
| 2012/0167604 | A1 * | 7/2012 | Yakumaru | F25B 13/00 62/126 |
| 2012/0174610 | A1 * | 7/2012 | Takayama | F25B 1/10 62/196.1 |
| 2012/0255323 | A1 * | 10/2012 | Kim | F25B 13/00 62/498 |
| 2013/0152626 | A1 * | 6/2013 | Feng | C09K 5/045 62/513 |
| 2013/0167572 | A1 * | 7/2013 | Yamashita | F25B 13/00 62/190 |
| 2013/0227976 | A1 * | 9/2013 | Yamashita | F24F 3/065 62/126 |
| 2014/0182329 | A1 | 7/2014 | Yamashita et al. | |
| 2014/0216092 | A1 * | 8/2014 | Tashiro | F25B 47/02 62/276 |
| 2014/0260386 | A1 * | 9/2014 | Hatanaka | F25B 49/02 62/196.1 |
| 2014/0360218 | A1 | 12/2014 | Takenaka et al. | |
| 2015/0233622 | A1 * | 8/2015 | Yajima | F25B 13/00 62/129 |

FOREIGN PATENT DOCUMENTS

| | | | | |
|---|---|---|---|---|
| JP | H04-006636 | A | 1/1992 | |
| JP | H06-137690 | A | 5/1994 | |
| JP | H06-137691 | A | 5/1994 | |
| JP | H06-331223 | A | 11/1994 | |
| JP | 2005-226950 | A | 8/2005 | |
| JP | 2008-180435 | A | 8/2008 | |
| JP | WO 2012049702 | A1 * | 4/2012 | F25B 13/00 |
| JP | WO 2012101672 | A1 * | 8/2012 | F25B 1/00 |
| WO | 2004/070293 | A1 | 8/2004 | |
| WO | 2010/131378 | A1 | 11/2010 | |
| WO | 2011/030430 | A1 | 3/2011 | |
| WO | 2013/038577 | A1 | 3/2013 | |
| WO | 2013/051177 | A1 | 4/2013 | |
| WO | 2013/069044 | A1 | 5/2013 | |
| WO | 2013/111176 | A1 | 8/2013 | |

OTHER PUBLICATIONS

Office Action dated Jul. 5, 2016 for the corresponding JP application No. 2015-533845 (with English translation).

International Search Report of the International Searching Authority dated Nov. 19, 2013 for the corresponding international application No. PCT/JP2013/072993 (and English translation).

* cited by examiner

FIG. 7

| TYPE OF REFRIGERANT | CT[°C] | SC[°C] | SATURATION TEMPERATURE [°C] AT $P_K$ | SATURATION TEMPERATURE [°C] AT $P_M$ | QUALITY $X_M$ |
|---|---|---|---|---|---|
| R32 | 55 | 20 | 35 | 15 | 0.1293 |
| | 55 | 10 | 45 | 15 | 0.2016 |
| | 55 | 0 | 55 | 15 | 0.2842 |
| | 45 | 20 | 25 | 15 | 0.0633 |
| | 45 | 10 | 35 | 15 | 0.1310 |
| | 45 | 0 | 45 | 15 | 0.2050 |
| | 55 | 20 | 35 | 10 | 0.1560 |
| | 55 | 10 | 45 | 10 | 0.2261 |
| | 55 | 0 | 55 | 10 | 0.3062 |
| | 45 | 20 | 25 | 10 | 0.0919 |
| | 45 | 10 | 35 | 10 | 0.1576 |
| | 45 | 0 | 45 | 10 | 0.2294 |
| R32 (74%) + R1234yf (26%) | 55 | 20 | 35 | 15 | 0.1511 |
| | 55 | 10 | 45 | 15 | 0.2298 |
| | 55 | 0 | 55 | 15 | 0.3076 |
| | 45 | 20 | 25 | 15 | 0.0791 |
| | 45 | 10 | 35 | 15 | 0.1529 |
| | 45 | 0 | 45 | 15 | 0.2218 |
| | 55 | 20 | 35 | 10 | 0.1797 |
| | 55 | 10 | 45 | 10 | 0.2561 |
| | 55 | 0 | 55 | 10 | 0.3316 |
| | 45 | 20 | 25 | 10 | 0.1097 |
| | 45 | 10 | 35 | 10 | 0.1814 |
| | 45 | 0 | 45 | 10 | 0.2483 |
| R32 (44%) + R1234yf (56%) | 55 | 20 | 35 | 15 | 0.1852 |
| | 55 | 10 | 45 | 15 | 0.2702 |
| | 55 | 0 | 55 | 15 | 0.3318 |
| | 45 | 20 | 25 | 15 | 0.1069 |
| | 45 | 10 | 35 | 15 | 0.1869 |
| | 45 | 0 | 45 | 15 | 0.2400 |
| | 55 | 20 | 35 | 10 | 0.2159 |
| | 55 | 10 | 45 | 10 | 0.2986 |
| | 55 | 0 | 55 | 10 | 0.3585 |
| | 45 | 20 | 25 | 10 | 0.1397 |
| | 45 | 10 | 35 | 10 | 0.2175 |
| | 45 | 0 | 45 | 10 | 0.2692 |

AIR-CONDITIONING APPARATUS INCLUDING MULTIPLE EXPANSION DEVICES

CROSS REFERENCE TO RELATED APPLICATION

This application is a U.S. national stage application of International Application No. PCT/JP2013/072993 filed on Aug. 28, 2013, the disclosure of which is incorporated herein by reference.

TECHNICAL FIELD

The present invention relates to an air-conditioning apparatus.

BACKGROUND ART

In air-conditioning apparatuses, such as existing cooling/heating switching-type multi-air-conditioning apparatuses for buildings, at the time of cooling operation, high-pressure liquid refrigerant having flowed out of a condenser (heat source side heat exchanger) is fed into an extension pipe connecting between an outdoor unit and an indoor unit.

In an air-conditioning apparatus capable of performing cooling and heating mixed operation also, at the time of cooling operation, high-pressure liquid refrigerant having flowed out of a condenser is fed into an extension pipe (see, for example, Patent Literature 1).

Additionally, there is known an air-conditioning apparatus including a heat medium relay unit interposed between an outdoor unit and indoor units (see, for example, Patent Literature 2). In this air-conditioning apparatus, the outdoor unit and the heat medium relay unit are connected with two refrigerant pipes through which heat source side refrigerant passes, and the heat medium relay unit and each indoor unit are connected with two heat medium pipes through which a heat medium passes. In the heat medium relay unit, heat is exchanged between the heat source side refrigerant and the heat medium.

Furthermore, there is known a refrigeration cycle including a high pressure receiver with a built-in heat exchanger disposed at a condenser outlet (see, for example, Patent Literature 3). In this refrigeration cycle, high-temperature refrigerant having passed through a condenser exchanges heat with low-temperature bypass refrigerant having passed through an expansion valve in the high pressure receiver with the built-in heat exchanger to be subcooled.

Furthermore, there is known an air-conditioning apparatus including a heat source side expansion valve in a heat source unit (see, for example, Patent Literature 4). The heat source side expansion valve is provided on the liquid side of a heat source side heat exchanger, and regulates the pressure and flow rate of refrigerant.

CITATION LIST

Patent Literature

Patent Literature 1: Japanese Unexamined Patent Application Publication No. 4-6636 (pages 3 to 6, FIGS. 1 to 4, for example)

Patent Literature 2: International Publication No. 2011/030430 (paragraphs 0031 to 0047, FIG. 3, for example)

Patent Literature 3: Japanese Unexamined Patent Application Publication No. 6-331223 (paragraph 0017, FIG. 1, for example)

Patent Literature 4: International Publication No. 2004/070293 (pages 7 to 8, FIG. 1, for example)

SUMMARY OF INVENTION

Technical Problem

In existing multi-air-conditioning apparatuses for buildings, since high-pressure liquid refrigerant having flowed out of a condenser (heat source side heat exchanger) during cooling operation is fed into an extension pipe, if the extension pipe is long (for example, 100 m), there is a problem in that the amount of refrigerant in an entire refrigerant circuit is large. For this reason, there is a problem in that, in the unlikely event of refrigerant leakage to the outside, the environmental impact is large.

In the air-conditioning apparatus disclosed in Patent Literature 1, in a cooling and heating mixed operation mode, two-phase refrigerant flows into the extension pipe. However, in a cooling only operation mode in which the largest amount of refrigerant is needed (an operation mode in which all indoor units perform cooling operation (including stopping)), liquid refrigerant flows into the extension pipe. Thus, there is a problem in that the amount of refrigerant to be sealed in a refrigerant circuit cannot be reduced.

In the air-conditioning apparatus disclosed in Patent Literature 2, since not refrigerant but a heat medium flows between the heat medium relay unit and each indoor unit, the amount of refrigerant in an entire refrigerant circuit can be reduced. However, this is a special form of air-conditioning apparatus, and thus there is a problem in that the amount of refrigerant in a standard air-conditioning apparatus in which refrigerant flows to indoor units cannot be reduced.

In the refrigeration cycle disclosed in Patent Literature 3, since refrigerant can be subcooled in the high pressure receiver with the built-in heat exchanger provided at the condenser outlet, a degree of subcooling of refrigerant at the condenser outlet can be reduced. This enables a reduction in the amount of refrigerant in an entire refrigerant circuit. However, the method in which the amount of refrigerant is reduced by reducing the degree of subcooling of the refrigerant at the condenser outlet is a typical method, and a method for reducing the amount of refrigerant further from such a state is not disclosed.

In the air-conditioning apparatus disclosed in Patent Literature 4, the heat source side expansion valve is opened in cooling operation, and an opening degree thereof is regulated to reduce the pressure of liquid refrigerant having flowed through a liquid refrigerant pipe in heating operation. However, there is no suggestion that the amount of refrigerant in a refrigerant circuit be reduced by controlling the heat source side expansion valve.

The present invention has been accomplished to solve the above-described problems, and an object thereof is to provide an air-conditioning apparatus enabling a reduction in the amount of refrigerant in a refrigerant circuit.

Solution to Problem

An air-conditioning apparatus according to the present invention includes a refrigerant circuit connecting, by a refrigerant pipe, a compressor, a first heat exchanger, at least one first expansion device, and at least one second heat exchanger, the refrigerant circuit circulating refrigerant therein. The compressor and the first heat exchanger are housed in a heat source unit, the at least one first expansion device and the at least one second heat exchanger are housed in at least one casing installed at a location away from the heat source unit, the heat source unit and the at least one casing are connected via a plurality of extension pipes constituting a part of the refrigerant pipe, the refrigerant circuit enables cooling operation in which the first heat exchanger operates as a condenser and the at least one second heat exchanger in a non-stopped state operates as an evaporator, the heat source unit houses a second expansion device provided at a location on a downstream side with respect to the at least one first heat exchanger and on an upstream side with respect to the first expansion device in a refrigerant flow direction in the cooling operation, and the second expansion device and the at least one first expansion device are connected via a first extension pipe being one of the plurality of extension pipes. The second expansion device reduces a pressure of refrigerant flowing into the first extension pipe in the cooling operation to cause the refrigerant to turn into refrigerant having a medium pressure and in a two-phase state, and the medium pressure is lower than a refrigerant pressure in the condenser and higher than a refrigerant pressure in the evaporator. In the cooling operation, the refrigerant having the medium pressure and in the two-phase state is caused to flow through the first extension pipe.

Advantageous Effects of Invention

According to the present invention, the refrigerant that is to flow into the first extension pipe is reduced in pressure by the second expansion device so that the refrigerant is put into a two-phase state, thereby enabling a reduction in the density of the refrigerant in the first extension pipe. Thus, the amount of refrigerant in the refrigerant circuit can be reduced.

BRIEF DESCRIPTION OF DRAWINGS

FIG. 7 illustrates results obtained by calculating a quality $X_M$ of medium-pressure two-phase refrigerant in an extension pipe (on a two-phase side) 5*a* at each condensing temperature CT, each degree of subcooling SC, and each saturation temperature at a pressure $P_M$ in the air-conditioning apparatus according to Embodiment 1 of the present invention.

DESCRIPTION OF EMBODIMENTS

Embodiment 1

Figure 1:
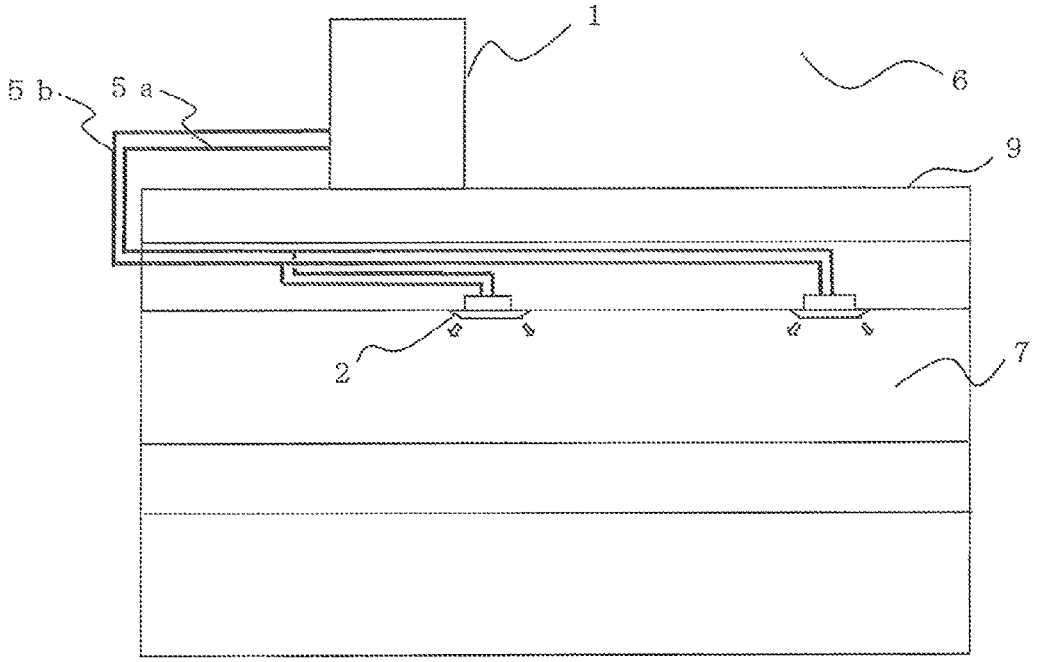
FIG. 1 is a schematic view illustrating an example of installation of an air-conditioning apparatus according to Embodiment 1 of the present invention.

An air-conditioning apparatus according to Embodiment 1 of the present invention will be described. FIG. 1 is a schematic view illustrating an example of installation of the air-conditioning apparatus according to Embodiment 1. In this air-conditioning apparatus, a refrigeration cycle in which refrigerant circulates is used, and thus either a cooling mode or a heating mode can be selected as an operation mode. It is noted that the dimensional relationships among component members, their shapes, or the like in the following figures including FIG. 1 may be different from the actual ones.

As illustrated in FIG. 1, the air-conditioning apparatus according to Embodiment 1 includes one outdoor unit 1, which is a heat source unit, and a plurality of indoor units 2*a* to 2*d* (which are each an example of a casing) installed at locations away from the outdoor unit 1. Hereinafter, the indoor units 2*a* to 2*d* may be collectively referred to as indoor units 2. The outdoor unit 1 and the indoor units 2 are connected to each other via extension pipes (refrigerant pipes) 5*a* and 5*b* through which refrigerant passes. Cooling energy or heating energy generated in the outdoor unit 1 is conveyed to the indoor units 2 via the extension pipe 5*a* or 5*b*.

The outdoor unit 1 is usually installed in an outdoor space 6, which is a space outside a building 9, such as a multi-storied building, (for example, a rooftop), and supplies cooling energy or heating energy to the indoor units 2. The indoor units 2 are each installed at a location at which temperature-regulated air can be supplied to an indoor space 7, which is a space inside the building 9, (for example, a room), and each supply cooling air or heating air to the indoor space 7, which is an air-conditioned space.

In the air-conditioning apparatus according to Embodiment 1, the outdoor unit 1 and each indoor unit 2 are connected to each other using two extension pipes 5*a* and 5*b*.

It is noted that, although FIG. 1 illustrates the case where the indoor units 2 are of a ceiling cassette type, the type of the indoor units 2 is not limited to this. For example, the indoor units 2 may be of any type, such as a ceiling embedded type or a ceiling suspended type, that can blow heating air or cooling air into the indoor space 7 directly or via a duct or the like.

Additionally, although FIG. 1 illustrates the case where the outdoor unit 1 is installed in the outdoor space 6, its installation place is not limited to this. For example, the outdoor unit 1 may be installed in an enclosed space, such as a machine room in which a ventilation opening is provided, or may be installed inside the building 9 as long as waste heat can be discharged to the outside of the building 9 through an exhaust duct. Alternatively, when the outdoor unit 1 used is of a water-cooled type, the outdoor unit 1 may be installed inside the building 9. Even when the outdoor unit 1 is installed in such places, no particular problem will arise.

Furthermore, the numbers of the connected outdoor units 1 and indoor units 2 are not limited to those illustrated in FIG. 1. The numbers of the outdoor units 1 and indoor units 2 to be connected may be determined depending on the building 9 in which the air-conditioning apparatus according to Embodiment 1 is to be installed.

Figure 2:
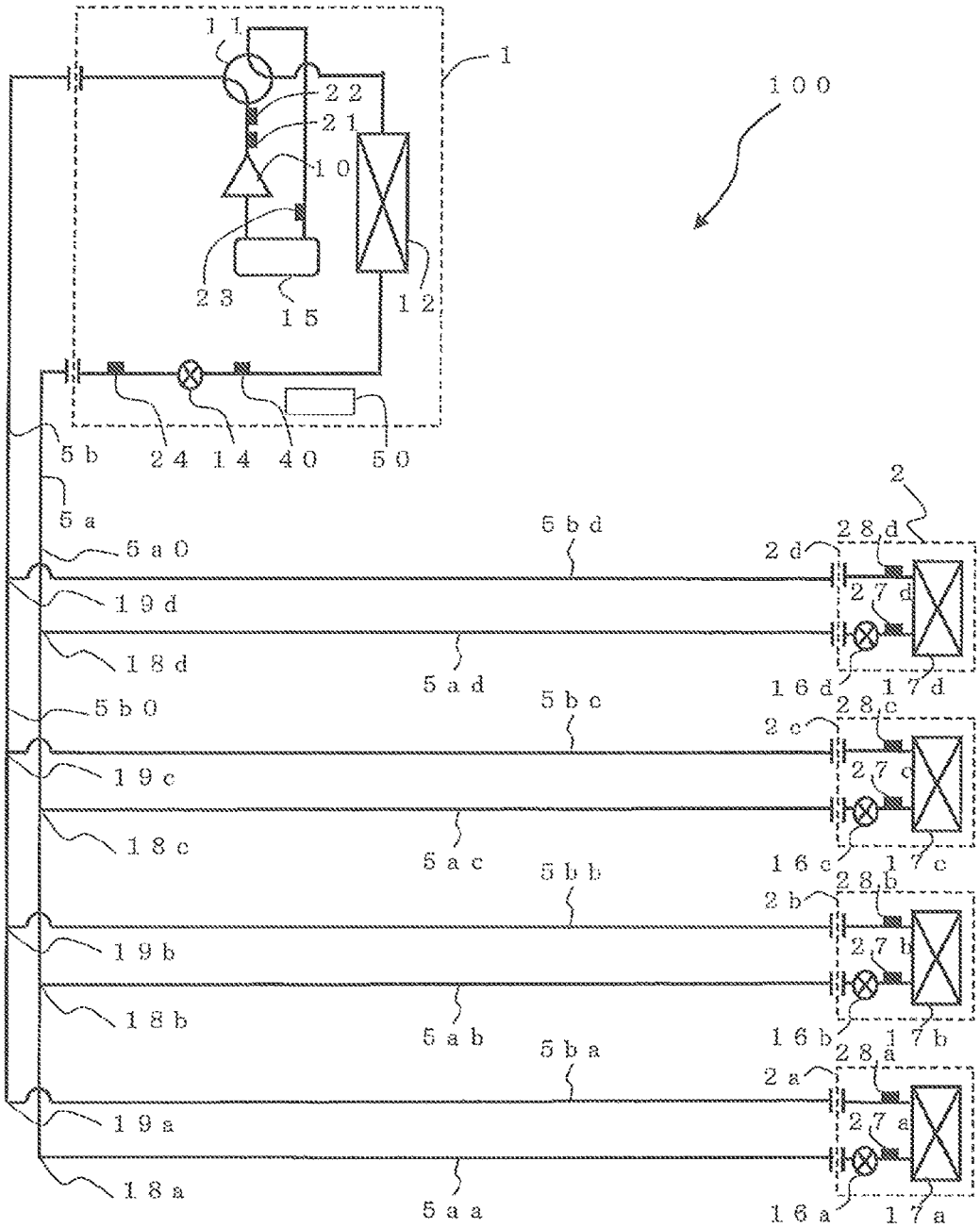
FIG. 2 is a schematic circuit configuration diagram illustrating an example of a circuit configuration of the air-conditioning apparatus according to Embodiment 1 of the present invention.

FIG. 2 is a schematic circuit configuration diagram illustrating an example of a circuit configuration of the air-conditioning apparatus (hereinafter referred to as an air-conditioning apparatus 100) according to Embodiment 1. The detailed configuration of the air-conditioning apparatus 100 will be described with reference to FIG. 2. As illustrated in FIG. 2, the outdoor unit 1 and the indoor units 2 are connected to each other with the extension pipe (refrigerant pipe) 5*a* and the extension pipe (refrigerant pipe) 5*b* through which refrigerant flows.

[Outdoor Unit 1]

In the outdoor unit 1, there are installed an accumulator 15, a compressor 10, a refrigerant flow switching device 11, such as a four-way valve, a heat source side heat exchanger 12 (an example of a first heat exchanger), and an expansion device 14 (an example of a second expansion device) that are connected in series with a refrigerant pipe. The accumulator 15, the compressor 10, the refrigerant flow switching device 11, the heat source side heat exchanger 12, and the expansion device 14 constitute a part of a refrigerant circuit.

The compressor 10 sucks refrigerant and compresses the refrigerant to a high-temperature, high-pressure state, and it is recommended that the compressor 10 be, for example, an inverter compressor or the like capable of capacity control. A compressor used as the compressor 10 is of, for example, a low-pressure shell structure in which a compression chamber is included in an air-tight container that is under a low-pressure refrigerant pressure atmosphere, and in which low-pressure refrigerant in the air-tight container is sucked and compressed. The refrigerant flow switching device 11 switches between the flow of refrigerant during cooling operation and the flow of refrigerant during heating operation. The heat source side heat exchanger 12 functions as a condenser (or a radiator) during cooling operation, and functions as an evaporator during heating operation. The heat source side heat exchanger 12 exchanges heat between refrigerant flowing through the inside thereof and air supplied from a fan, which is not illustrated, and evaporates and gasifies or condenses and liquefies the refrigerant. The accumulator 15 is provided on a suction side of the compressor 10, and stores excess refrigerant in the refrigerant circuit. If there is no excess refrigerant, or if there is a little excess refrigerant, the accumulator 15 does not have to be provided.

At the time of cooling operation, the expansion device 14 reduces the pressure of the liquid refrigerant condensed in the heat source side heat exchanger 12 to cause the refrigerant to turn into medium-pressure two-phase refrigerant and to flow into the extension pipe 5*a*. Here, the medium pressure is a pressure that is lower than a high pressure (the pressure of refrigerant in the condenser or the pressure of refrigerant discharged from the compressor 10), and higher than a low pressure (the pressure of refrigerant in an evaporator or the pressure of refrigerant sucked into the compressor 10) in the refrigeration cycle.

The outdoor unit 1 includes a discharge refrigerant temperature detection device 21, a high pressure detection device 22, a low pressure detection device 23, and a liquid refrigerant temperature detection device 24 in addition to the compressor 10, the refrigerant flow switching device 11, the heat source side heat exchanger 12, the expansion device 14, and the accumulator 15. The discharge refrigerant temperature detection device 21 detects a temperature of refrigerant discharged from the compressor 10, and outputs detected temperature information. The high pressure detection device 22 detects a pressure (high pressure) of the refrigerant discharged from the compressor 10, and outputs detected pressure information. The low pressure detection device 23 detects a pressure (low pressure) of refrigerant flowing into the accumulator 15, and outputs detected pressure information. The liquid refrigerant temperature detection device 24 is provided at a location on a downstream side of the expansion device 14 in a refrigerant flow direction during cooling operation, detects a temperature of liquid refrigerant (two-phase refrigerant), and outputs detected temperature information. It is noted that a liquid refrigerant temperature detection device 40 may be provided at a location on a downstream side of the heat source side heat exchanger 12 and on an upstream side of the expansion device 14 in the refrigerant flow direction during cooling operation. The liquid refrigerant temperature detection device 40 will be described later.

The outdoor unit 1 also includes a controller 50. The controller 50 is, for example, a microcomputer including a CPU, a ROM, a RAM, an I/O port, and the like. The controller 50 performs various control operations on the basis of detected pieces of information of various detection devices (for example, the discharge refrigerant temperature detection device 21, the high pressure detection device 22, the low pressure detection device 23, the liquid refrigerant temperature detection device 24) and an instruction provided from a remote control or the like. For example, the controller 50 controls a driving frequency of the compressor 10, a rotation speed (including on/off operation) of the fan, an opening degree of the expansion device 14, switching of the refrigerant flow switching device 11, and the like, and implements operation modes to be described. Furthermore, the controller 50 can communicate with controllers of the respective indoor units 2 to be described.

[Indoor Units 2]

In the plurality of indoor units 2*a* to 2*d*, there are installed use side heat exchangers 17*a*, 17*b*, 17*c*, and 17*d* (which are each an example of a second heat exchanger), respectively. Hereinafter, the use side heat exchangers 17*a* to 17*d* may be collectively referred to as use side heat exchangers 17. The use side heat exchangers 17 are connected to the outdoor unit 1 via the extension pipes 5*a* and 5*b*. Each use side heat exchanger 17 exchanges heat between refrigerant flowing through the inside thereof and air supplied from a fan, which is not illustrated, and generates cooling air or heating air to be supplied to the indoor space 7. The use side heat exchangers 17 each function as an evaporator during cooling operation, and function as a condenser (or a radiator) during heating operation.

Furthermore, in the indoor units 2*a* to 2*d*, there are installed expansion devices 16*a*, 16*b*, 16*c*, and 16*d* (which are each an example of a first expansion device), respectively. Hereinafter, the expansion devices 16*a* to 16*d* may be collectively referred to as expansion devices 16. The expansion devices 16 are provided at locations on an upstream side of the respective use side heat exchangers 17 in the refrigerant flow direction during cooling operation, and are connected to the extension pipe 5*b*. The use side heat exchangers 17 and the expansion devices 16 constitute a part of the refrigerant circuit together with the accumulator 15, the compressor 10, the refrigerant flow switching device 11, the heat source side heat exchanger 12, the expansion device 14, and the like that are installed in the outdoor unit 1.

The indoor units 2*a* to 2*d* respectively include liquid refrigerant temperature detection devices 27*a*, 27*b*, 27*c*, and 27*d* on a use side, and gas refrigerant temperature detection devices 28*a*, 28*b*, 28*c*, and 28*d* on the use side. Hereinafter, the liquid refrigerant temperature detection devices 27*a* to 27*d* may be collectively referred to as liquid refrigerant temperature detection devices 27, and the gas refrigerant temperature detection devices 28*a* to 28*d* may be collectively referred to as gas refrigerant temperature detection devices 28. The liquid refrigerant temperature detection devices 27 are provided at locations on a downstream side of the respective expansion devices 16 and on the upstream side of the respective use side heat exchangers 17 in the refrigerant flow direction during cooling operation. The gas refrigerant temperature detection devices 28 are provided at locations on a downstream side of the respective use side heat exchangers 17 in the refrigerant flow direction during cooling operation.

The indoor units 2*a* to 2*d* also include controllers, which are not illustrated. The controllers are each, for example, a microcomputer including a CPU, a ROM, a RAM, an I/O port, and the like. The controllers perform various control operations on the basis of detected pieces of information provided from various detection devices (for example, the respective liquid refrigerant temperature detection devices 27, the respective gas refrigerant temperature detection devices 28, and the like), information acquired from the controller 50 of the outdoor unit 1 through communications, and instructions provided from remote controls or the like.

Although FIG. 2 illustrates the case where four indoor units 2 are connected, as in FIG. 1, the number of the indoor units 2 connected is not limited to four illustrated in FIG. 2.

The extension pipe 5*a* includes a main pipe 5*a*0 connected to the outdoor unit 1, and branch pipes 5*aa*, 5*ab*, 5*ac*, and 5*ad* respectively connecting the main pipe 5*a*0 with the indoor units 2*a*, 2*b*, 2*c*, and 2*d*. The branch pipe 5*aa* branches off from the main pipe 5*a*0 in a branch unit 18*a*, the branch pipe 5*ab* branches off from the main pipe 5*a*0 in a branch unit 18*b*, the branch pipe 5*ac* branches off from the main pipe 5*a*0 in a branch unit 18*c*, and the branch pipe 5*ad* branches off from the main pipe 5*a*0 in a branch unit 18*d*.

The extension pipe 5*b* includes a main pipe 5*b*0 connected to the outdoor unit 1, and branch pipes 5*ba*, 5*bb*, 5*bc*, and 5*bd* respectively connecting the main pipe 5*b*0 with the indoor units 2*a*, 2*b*, 2*c*, and 2*d*. The branch pipe 5*ba* meets (branches off from) the main pipe 5*b*0 in a junction unit 19*a*, the branch pipe 5*bb* meets (branches off from) the main pipe 5*b*0 in a junction unit 19*b*, the branch pipe 5*bc* meets (branches off from) the main pipe 5*b*0 in a junction unit 19*c*, and the branch pipe 5*bd* meets (branches off from) the main pipe 5*b*0 in a junction unit 19*d*.

Each operation mode implemented by the air-conditioning apparatus 100 will be described. The operation modes include at least a cooling operation mode and a heating operation mode. This air-conditioning apparatus 100 decides on either the cooling operation mode or the heating operation mode for an operation mode of the outdoor unit 1 on the basis of, for example, an instruction provided from each indoor unit 2. That is, the air-conditioning apparatus 100 allows all the indoor units 2 to perform the same operation (cooling operation or heating operation), and thus regulates indoor temperatures. It is noted that operation/stopping of each indoor unit 2 can be freely performed in both of the cooling operation mode and the heating operation mode.

The cooling operation mode is an operation mode in which cooling operation is performed in all the indoor units 2 that are operating. That is, in the cooling operation mode, all the use side heat exchangers 17 in a non-stopped state each operate as an evaporator. The heating operation mode is an operation mode in which heating operation is performed in all the indoor units 2 that are operating. That is, in the heating operation mode, all the use side heat exchangers 17 in a non-stopped state each operate as a condenser. Each operation mode will be described below together with the flow of refrigerant.

[Cooling Operation Mode]

Figure 3:
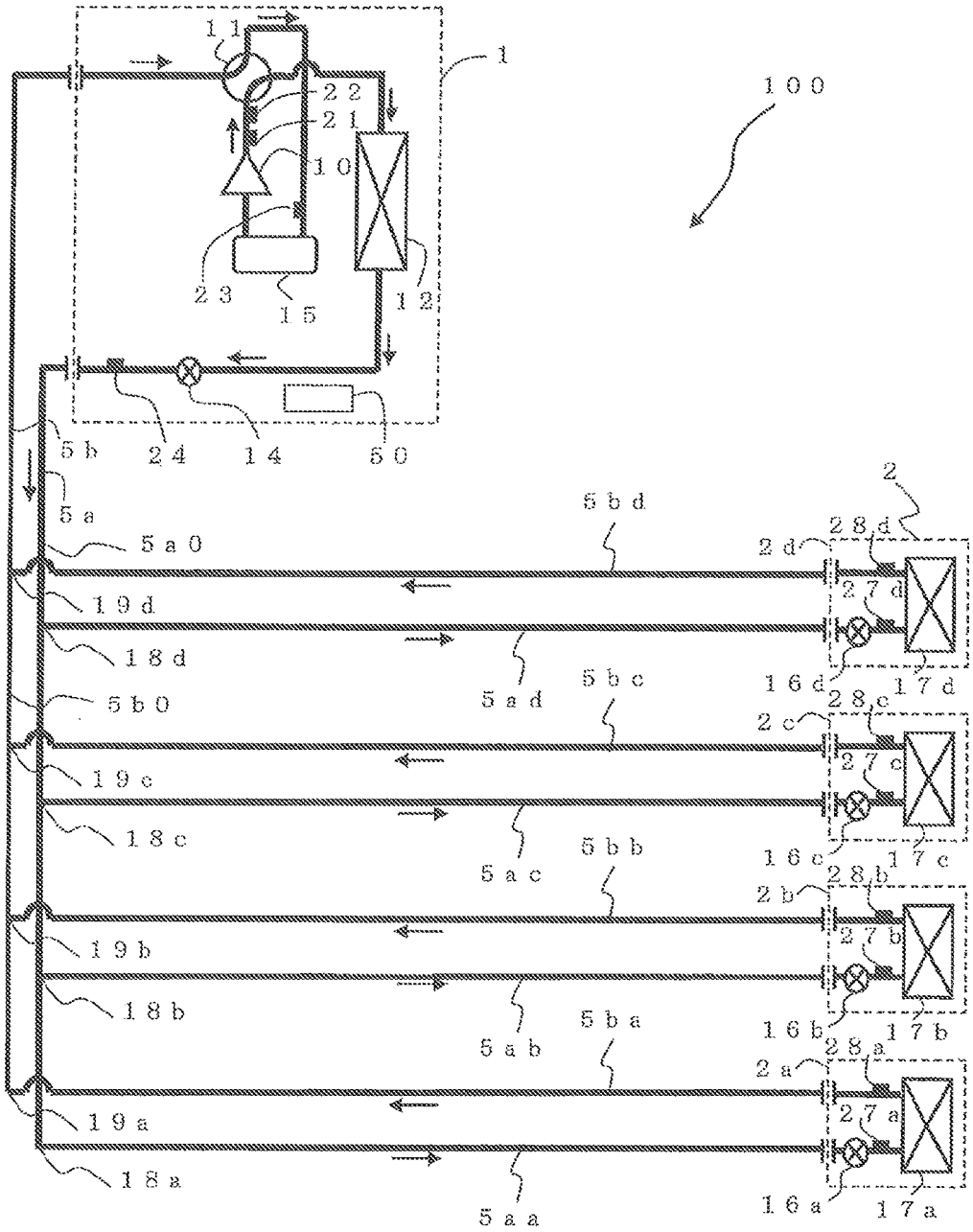
FIG. 3 is a circuit configuration diagram illustrating the flow of refrigerant in a cooling operation mode of the air-conditioning apparatus according to Embodiment 1 of the present invention.

First, the cooling operation mode will be described. FIG. 3 is a circuit configuration diagram illustrating the flow of refrigerant in the cooling operation mode of the air-conditioning apparatus 100. FIG. 3 illustrates the case where a cooling energy load is generated in all the use side heat exchangers 17. It is noted that, in FIG. 3, pipes through which refrigerant flows are represented by thick lines and refrigerant flow directions are indicated by solid arrows.

In the case of the cooling operation mode illustrated in FIG. 3, in the outdoor unit 1, the refrigerant flow switching device 11 is switched so that refrigerant discharged from the compressor 10 flows into the heat source side heat exchanger 12. Low-temperature, low-pressure refrigerant is compressed by the compressor 10 to turn into high-temperature, high-pressure gas refrigerant, and is discharged. The high-temperature, high-pressure gas refrigerant discharged from the compressor 10 flows into the heat source side heat exchanger 12 via the refrigerant flow switching device 11. The high-temperature, high-pressure gas refrigerant having flowed into the heat source side heat exchanger 12 is condensed and liquefied in the heat source side heat exchanger 12 while transferring heat to outdoor air to turn into high-pressure liquid refrigerant, and flows out of the heat source side heat exchanger 12. The high-pressure liquid refrigerant having flowed out of the heat source side heat exchanger 12 flows into the expansion device 14, is reduced in pressure to turn into medium-pressure two-phase refrigerant, and flows out of the outdoor unit 1.

At this time, an opening degree (opening area) of the expansion device 14 is controlled so that, for example, a detected temperature of the liquid refrigerant temperature detection device 24 approaches a saturation temperature (control target value) at a target medium pressure. Control of the expansion device 14 will be described in detail later.

The medium-pressure two-phase refrigerant having flowed out of the outdoor unit 1 flows into the main pipe 5*a*0 of the extension pipe (on a two-phase side) 5*a*. The medium-pressure two-phase refrigerant having flowed into the main pipe 5*a*0 is divided by the branch units 18*a* to 18*d* to flow through the branch pipes 5*aa* to 5*ad*, and flows into the respective indoor units 2 (2*a* to 2*d*). The medium-pressure two-phase refrigerant having flowed into the indoor units 2 is expanded by the respective expansion devices 16 (16*a* to 16*d*) to turn into low-temperature, low-pressure two-phase refrigerant. At this time, opening degrees (opening areas) of the expansion devices 16 are controlled by the controllers of the respective indoor units 2 so that, for example, differences in temperature (degrees of superheat) between detected temperatures of the respective gas refrigerant temperature detection devices 28 and detected temperatures of the respective liquid refrigerant temperature detection devices 27 each approach a control target value. The low-temperature, low-pressure two-phase refrigerant flows into the respective use side heat exchangers 17 (17*a* to 17*d*) each operating as an evaporator, receives heat from air sent to the use side heat exchangers 17, and evaporates. Thus, the low-temperature, low-pressure two-phase refrigerant turns into low-temperature, low-pressure gas refrigerant, and also air to be blown into the indoor space 7 is cooled. The low-temperature, low-pressure gas refrigerant having flowed out of the use side heat exchangers 17 flows out of the respective indoor units 2.

The low-temperature, low-pressure gas refrigerant having flowed out of the indoor units 2 passes through the branch pipes 5*ba* to 5*bd*, the junction units 19*a* to 19*d*, and the main pipe 5*b*0 that are included in the extension pipe (on a gas side) 5*b*, and flows into the outdoor unit 1 again. The low-temperature, low-pressure gas refrigerant having flowed into the outdoor unit 1 passes through the refrigerant flow switching device 11, flows into the accumulator 15, and then is sucked into the compressor 10 again.

Thus, when refrigerant flowing out of the outdoor unit 1 is put into a two-phase state by the expansion device 14, the refrigerant in the extension pipe (on the two-phase side) 5*a* connecting the outdoor unit 1 with the indoor units 2 can be in the two-phase state. The two-phase refrigerant is a mixture of liquid refrigerant and gas refrigerant whose density is smaller than that of the liquid refrigerant. Thus, when the refrigerant in the extension pipe (on the two-phase side) 5*a* is in the two-phase state, the amount of the refrigerant in the extension pipe (on the two-phase side) 5*a* can be reduced by the amount of gas refrigerant mixed in the refrigerant in comparison with the case where the refrigerant in the extension pipe (on the two-phase side) 5*a* is in a liquid state.

Figure 4:
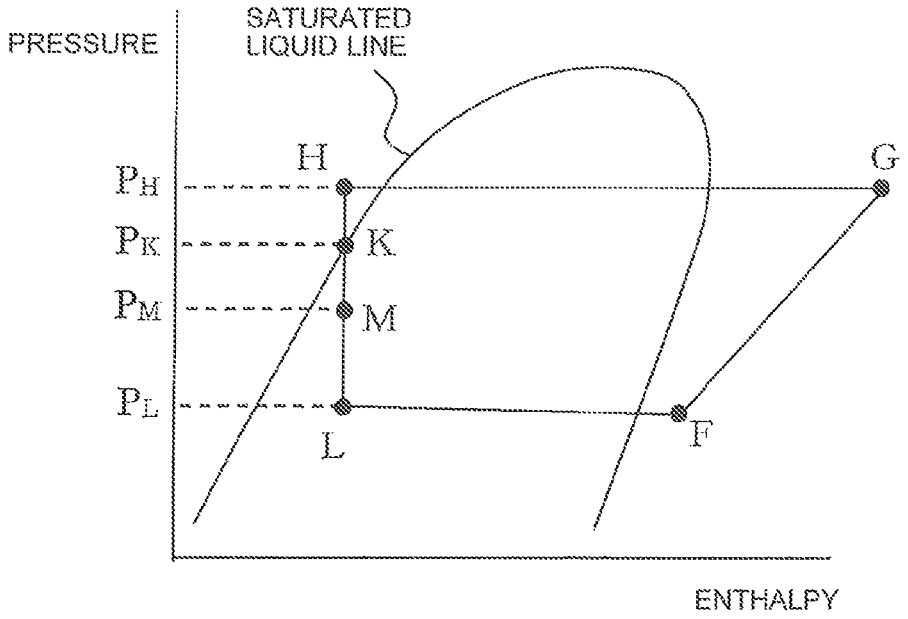
FIG. 4 is a p-h diagram representing a refrigerant state in the cooling operation mode of the air-conditioning apparatus according to Embodiment 1 of the present invention.

Next, details of a refrigerant state in the cooling operation mode will be described. FIG. 4 is a p-h diagram (pressure-enthalpy diagram) representing a refrigerant state in the cooling operation mode of the air-conditioning apparatus according to Embodiment 1. As illustrated in FIG. 4, in the cooling operation mode, low-pressure gas refrigerant sucked into the compressor 10 (a point F in FIG. 4) is compressed by the compressor 10 to turn into high-pressure (pressure $P_H$) gas refrigerant (a point G in FIG. 4), and is condensed in the heat source side heat exchanger 12 to turn into high-pressure liquid refrigerant (a point H in FIG. 4). This high-pressure liquid refrigerant is reduced in pressure by the expansion device 14 to turn into medium-pressure (pressure $P_M$) two-phase refrigerant (a point M in FIG. 4), and flows out of the outdoor unit 1.

The medium-pressure two-phase refrigerant having flowed out of the outdoor unit 1 passes through the extension pipe (on the two-phase side) 5*a*, and flows into the indoor units 2 (2*a* to 2*d*). The medium-pressure two-phase refrigerant having flowed into the indoor units 2 is reduced in pressure by the respective expansion devices 16 (16*a* to 16*d*) to turn into low-pressure (pressure $P_L$) two-phase refrigerant (a point L in FIG. 4). This low-pressure two-phase refrigerant evaporates in the use side heat exchangers 17 (17*a* to 17*d*) to turn into low-pressure gas refrigerant, and flows out of the respective indoor units 2.

The low-pressure gas refrigerant having flowed out of the indoor units 2 passes through the extension pipe (on the gas side) 5*b*, and flows into the outdoor unit 1. The low-pressure gas refrigerant having flowed into the outdoor unit 1 flows into the accumulator 15 (the point F in FIG. 4) through the refrigerant flow switching device 11, and is sucked into the compressor 10 again.

Here, no heat is assumed to transfer, the refrigerant whose pressure is reduced by the expansion device 14 undergoes an isenthalpic change from the point H to the point M in FIG. 4. The pressure $P_M$ of the medium-pressure two-phase refrigerant at the point M is a value smaller than a pressure $P_K$ at a saturated liquid point (a point K in FIG. 4) having the same enthalpy and larger than the pressure $P_L$ at an inlet of each use side heat exchanger 17.

Note that it is desirable that the expansion device 14 is a device (for example, an electronic expansion valve or the like) whose opening area can be changed. If an electronic expansion valve or the like is used as the expansion device 14, the pressure of refrigerant that is to be fed into the extension pipe 5*a* can be freely controlled. However, the expansion device 14 is not limited to the electronic expansion valve or the like. For example, a combination of a plurality of on-off valves, such as compact solenoid valves, may be used as the expansion device 14 so that an opening area can be selected from multiple opening areas by appropriately switching between on-off patterns of these valves. A capillary tube may also be used as the expansion device 14 so that a predetermined degree of subcooling is produced depending on a pressure loss of refrigerant. Even if these are used, although controllability deteriorates slightly, medium-pressure two-phase refrigerant can be generated.

During the implementation of the cooling operation mode, refrigerant does not have to be fed into use side heat exchangers 17 having no heat load (including that in a thermostat-off state), and thus the operations of them are stopped. At this time, the expansion device 16 of an indoor unit 2 that has been stopped is fully closed, or an opening degree thereof is small to such an extent that the refrigerant does not flow.

Figure 5:
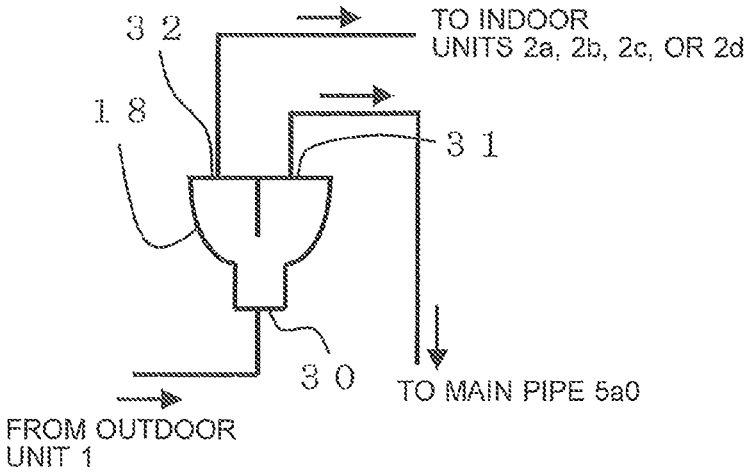
FIG. 5 illustrates an example of a configuration of a branch unit 18 of the air-conditioning apparatus according to Embodiment 1 of the present invention.
Figure 6:
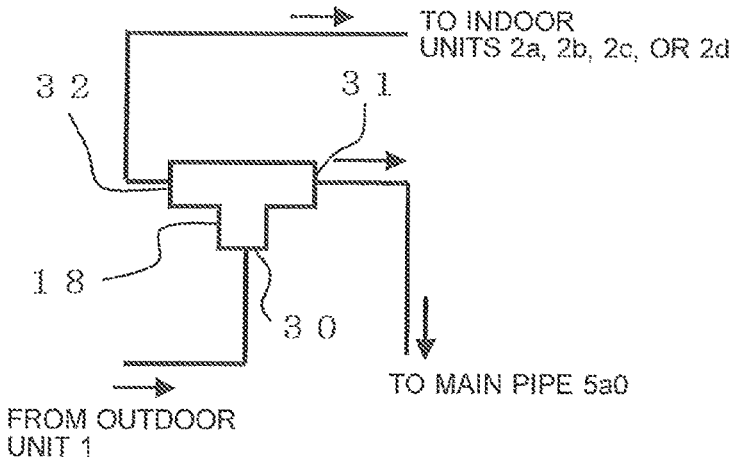
FIG. 6 illustrates an example of the configuration of the branch unit 18 of the air-conditioning apparatus according to Embodiment 1 of the present invention.

Furthermore, at points in the extension pipe (on the two-phase side) 5*a*, there are provided the branch units 18 (18*a* to 18*d*) for dividing medium-pressure two-phase refrigerant flowing through the main pipe 5*a*0 to cause it to flow into the respective branch pipes 5*aa* to 5*ad*. The branch units 18 are configured to, at the time of cooling operation, divide two-phase state refrigerant flowing through the main pipe 5*a*0 to cause part of the two-phase state refrigerant to flow into the respective branch pipes 5*aa* to 5*ad* while the refrigerant remains in the two-phase state. FIG. 5 and FIG. 6 each illustrate an example of a configuration of each branch unit 18. The branch unit 18 illustrated in FIG. 5 has a Y-shaped (Y letter-shaped) joint structure, and the branch unit 18 illustrated in FIG. 6 has a T-shaped (T letter-shaped) joint structure. Both of the branch units 18 illustrated in FIG. 5 and FIG. 6 are each installed in an orientation in which medium-pressure two-phase refrigerant flowing upward from below in a gravity direction is divided to flow in substantially rightward and leftward directions.

The branch units 18 each include one inlet 30 into which refrigerant flows and two outlets 31 and 32 of which the refrigerant flows out in the cooling operation mode. For example, the outlets 31 and 32 are provided symmetrically to each other with respect to the inlet 30. The branch units 18 are each disposed so that the inlet 30 is positioned below the outlets 31 and 32. In the refrigerant flow direction during cooling operation, the inlet 30 is connected to an upstream side (outdoor unit 1 side) of the main pipe 5*a*0, the outlet 31 is connected to a downstream side of the main pipe 5*a*0, and the outlet 32 is connected to the branch pipes 5*aa*, 5*ab*, 5*ac*, or 5*ad*. The two-phase refrigerant having flowed upward from the upstream side of the main pipe 5*a*0 into the inlet 30 is divided to flow in the substantially rightward and leftward directions in each branch unit 18. Divided part of the two-phase refrigerant flows out of the outlet 32 on the left side, and flows to indoor units 2*a*, 2*b*, 2*c*, or 2*d* sides of the branch pipes 5*aa*, 5*ab*, 5*ac*, or 5*ad*. The remaining two-phase refrigerant flows out of the outlet 31 on the right side, and flows to the downstream side of the main pipe 5*a*0 directly. Thus, when the two-phase refrigerant is caused to flow from below the branch units 18 and divided to flow in the substantially rightward and leftward directions, gas refrigerant and liquid refrigerant contained in the two-phase refrigerant can be distributed in two directions at a substantially even ratio (gas-to-liquid ratio).

It is noted that the structure of each branch unit 18 is not limited to the structures illustrated in FIG. 5 and FIG. 6. As the branch units 18, any structure may be used in which two-phase refrigerant in which gas refrigerant and liquid refrigerant are reasonably mixed can be fed into both of branched passages. For example, even when the branch units 18 are each disposed so that the inlet 30 is positioned above the outlets 31 and 32, and two-phase refrigerant flowing downward from above is divided to flow in rightward and leftward directions, gas refrigerant and liquid refrigerant contained in the two-phase refrigerant can be distributed somewhat evenly. In addition, even when the branch units 18 are each slightly inclined with respect to an installation direction, if the angle of inclination is small (for example, 15 degrees or less), there is no problem, and the same effect is produced. Furthermore, in the indoor units 2 (2*a* to 2*d*), the respective expansion devices 16 are provided, and the amounts of refrigerant needed in the indoor units 2 are regulated by the expansion devices 16. For this reason, in each branched passage in the branch units 18, gas refrigerant and liquid refrigerant do not have to be distributed at a perfectly even ratio, and the liquid refrigerant and the gas refrigerant only have to be mixed in some amounts. Furthermore, the branch units 18 are not limited to a two-branch type, and may be configured so that a plurality of passages, such as four branches or six branches, branch off by using, for example, a header branch method.

Next, a quality of medium-pressure two-phase refrigerant whose pressure has been reduced by the expansion device 14 of the outdoor unit 1 will be described. (A dryness of refrigerant is referred to as a quality in this description.) To reduce the amount of refrigerant in the extension pipe (on the two-phase side) 5*a*, it is desirable to feed two-phase refrigerant that has a largest possible quality, that is, in which the ratio of gas is large into the extension pipe (on the two-phase side) 5*a*. It is noted that, since refrigerant condensed in the heat source side heat exchanger 12 is throttled (reduced in pressure) to turn into medium-pressure two-phase refrigerant as described above, an enthalpy of the medium-pressure two-phase refrigerant is equal to an enthalpy of refrigerant at an inlet of the expansion device 14 (an outlet of the heat source side heat exchanger 12) if there is no transfer of heat. Hence, as represented by the following Expression (1), the pressure $P_M$, which is a medium pressure, is equal to or smaller than the pressure $P_H$ at the inlet of the expansion device 14 (the outlet of the heat source side heat exchanger 12), is smaller than the pressure $P_K$ at the saturated liquid point having the same enthalpy as that at the inlet of the expansion device 14 (the outlet of the heat source side heat exchanger 12), and is larger than the pressure $P_L$ at the inlet of the use side heat exchanger 17 of each indoor unit 2.

[Math. 1]

$$P_H \geq P_K < P_M < P_L \quad (1)$$

Next, it is assumed that R32 is used as refrigerant. A condensing temperature (a temperature at which refrigerant in the heat source side heat exchanger 12 operating as a condenser during cooling operation is condensed) is assumed to be denoted by CT, the case where the condensing temperature CT is 55 degrees C. and the case where the condensing temperature CT is 45 degrees C. will be discussed. Also, a degree of subcooling of refrigerant at the outlet of the condenser (heat source side heat exchanger 12) is assumed to be denoted by SC, the case where the degree of subcooling SC is 20 degrees C., the case where the degree of subcooling SC is 10 degrees C., and the case where the degree of subcooling SC is 0 degrees C. will be discussed. Furthermore, the case where a saturation temperature at the pressure $P_M$ of medium-pressure two-phase refrigerant generated through throttling performed by the expansion device 14 is 15 degrees C. and the case where the saturation temperature is 10 degrees C. will be discussed. The pressure $P_M$ of the medium-pressure two-phase refrigerant generated through throttling performed by the expansion device 14 has the relationship of Expression (1), and indicates a value larger than the pressure $P_L$, which is a low pressure. Furthermore, since the expansion devices 16 are provided in the respective indoor units 2, the pressure $P_M$, which is a medium pressure, has to be a value somewhat larger than the pressure $P_L$, which is a low pressure. An evaporating temperature, which is a saturation temperature at the pressure $P_L$, which is a low pressure, ranges from around 0 degrees C. to 5 degrees C., and thus it is assumed that the saturation temperature at the pressure $P_M$, which is a medium pressure, ranges from around 10 degrees C. to 15 degrees C., larger than that at the pressure $P_L$.

FIG. 7 illustrates results obtained by calculating a quality $X_M$ of medium-pressure two-phase refrigerant in the extension pipe (on the two-phase side) 5*a* at each condensing temperature CT, each degree of subcooling SC, and each saturation temperature at the pressure $P_M$. FIG. 7 illustrates not only calculated results for R32, which is the type of refrigerant, but also calculated results for a refrigerant mixture of R32 and other refrigerant, which will be described later. It is noted that REFPROP Version 9.0 produced by NIST (National Institute of Standards and Technology) is used in calculation of the quality $X_M$.

As illustrated in FIG. 7, when the condensing temperature CT is 45 degrees C., the degree of subcooling SC is 20 degrees C., and the saturation temperature at the pressure $P_M$, which is a medium pressure, is 15 degrees C., the quality $X_M$ of medium-pressure two-phase refrigerant is 0.0633. When the condensing temperature CT is 55 degrees C., the degree of subcooling SC is 0 degrees C., and the saturation temperature at the pressure $P_M$, which is a medium pressure, is 10 degrees C., the quality $X_M$ of the medium-pressure two-phase refrigerant is 0.3062. On other conditions, qualities $X_M$ of the medium-pressure two-phase refrigerant are values ranging between these values. Thus, it is found that the quality $X_M$ of the medium-pressure two-phase refrigerant is from 0.0633 to 0.3062, and varies depending on conditions.

Furthermore, in the extension pipes 5*a* and 5*b*, it is assumed that the main pipes 5*a*0 and 5*b*0 are each 100 m in length, the branch pipes 5*aa* to 5*ad*, and 5*ba* to 5*bd* are each 50 m in length, the main pipe 5*a*0 and the branch pipes 5*aa* to 5*ad* on the two-phase side are pipes of 9.52 mm in outside diameter and 0.8 mm in wall thickness, the main pipe 5*b*0 on the gas side is a pipe of 22.2 mm in outside diameter and 1 mm in wall thickness, and the branch pipes 5*ba* to 5*bd* on the gas side are pipes of 15.88 mm in outside diameter and 1 mm in wall thickness. At this time, it is assumed that the outdoor unit 1 and indoor units 2 of 10 HP (cooling capacity of 28 kW) are used, when the expansion device 14 is fully open and liquid refrigerant is fed into the main pipe 5a0 and the branch pipes 5aa to 5ad, the approximate amounts of refrigerant in components during cooling operation are 6.616 kg in the condenser (heat source side heat exchanger 12), 0.828 kg in the evaporators (use side heat exchangers 17), 4.680 kg in the main pipe 5a0, 4.680 kg in the branch pipes 5aa to 5ad, 0.960 kg in the main pipe 5b0, 0.460 kg in the branch pipes 5ba to 5bd, and 0.317 kg in the other components, and thus there is a total of 18.541 kg of refrigerant in the refrigerant circuit. The amount of refrigerant in the main pipe 5a0 accounts for 25.2% of the amount of refrigerant in the entire refrigerant circuit, the amount of refrigerant in the branch pipes 5aa to 5ad accounts for 25.2% of the amount of refrigerant in the entire refrigerant circuit, and thus a combined total amount of refrigerant in the main pipe 5a0 and the branch pipes 5aa to 5ad, which are included in the extension pipe (on the two-phase side) 5a, accounts for as many as 50.4% of the amount of refrigerant in the entire refrigerant circuit. Hence, putting the refrigerant in the extension pipe (on the two-phase side) 5a into a two-phase state contributes greatly to a reduction in the amount of refrigerant. It is noted that, if the length of the extension pipe 5a is short, a percentage of the amount of refrigerant in the entire refrigerant circuit accounted for by the amount of refrigerant in the extension pipe 5a is small. For this reason, the effect of a reduction in the amount of refrigerant obtained by putting the refrigerant in the extension pipe 5a into a two-phase state varies depending on the length of the extension pipe 5a, and increases as the length of the extension pipe 5a increases.

In this operation state, the case where the opening degree of the expansion device 14 is regulated and the medium-pressure two-phase refrigerant is fed into the extension pipe (on the two-phase side) 5a will be discussed. The medium-pressure two-phase refrigerant having the quality $X_M$ of 0.0633 is assumed to be fed into the main pipe 5a0 and the branch pipes 5aa to 5ad, which are included in the extension pipe (on the two-phase side) 5a, the amount of refrigerant in the main pipe 5a0 is 4.394 kg, and the amount of refrigerant in the branch pipes 5aa to 5ad is 4.394 kg. Thus, the amount of refrigerant in the entire refrigerant circuit is 17.969 kg, which is reduced by 0.572 kg (3.1% of the amount of refrigerant in the entire refrigerant circuit) in comparison with the case where liquid refrigerant is fed into the extension pipe (on the two-phase side) 5a.

Furthermore, the medium-pressure two-phase refrigerant having the quality $X_M$ of 0.3062 is assumed to be fed into the main pipe 5a0 and the branch pipes 5aa to 5ad, which are included in the extension pipe (on the two-phase side) 5a, the amount of refrigerant in the main pipe 5a0 is 3.297 kg, and the amount of refrigerant in the branch pipes 5aa to 5ad is 3.297 kg. Thus, the amount of refrigerant in the entire refrigerant circuit is 15.775 kg, which is reduced by 2.766 kg (14.9% of the amount of refrigerant in the entire refrigerant circuit) in comparison with the case where liquid refrigerant is fed into the extension pipe (on the two-phase side) 5a.

Thus, when high-pressure liquid refrigerant is reduced in pressure by the expansion device 14 provided on an outlet side of the outdoor unit 1 during cooling operation, and the medium-pressure two-phase refrigerant is fed into the extension pipe (on the two-phase side) 5a, the amount of refrigerant in the extension pipe (on the two-phase side) 5a can be reduced, and the amount of refrigerant in the refrigerant circuit can therefore be reduced. In particular, in an air-conditioning apparatus, such as a multi-air-conditioning apparatus for buildings, in which the extension pipe 5a is long (for example, the length of the extension pipe 5a is 100 m), a larger amount of refrigerant can be reduced, and thus a high effect can be obtained. It is noted that, since Embodiment 1 is directed to a reduction in the amount of refrigerant to be charged in the refrigerant circuit, the operation is performed in which medium-pressure two-phase refrigerant is fed into the extension pipe (on the two-phase side) 5a almost at all times at the time of normal stable cooling operation except in the case where there is excess refrigerant because a small amount of refrigerant is needed in the refrigerant circuit in cooling operation (for example, the case where many indoor units 2 have been stopped).

At this time, in the case where refrigerant containing R32 as a main component is used, it is recommended that the quality $X_M$ of medium-pressure two-phase refrigerant be a value ranging from 0.0633 to 0.3062. Furthermore, in many cases, the degree of subcooling SC at the outlet of the condenser (heat source side heat exchanger 12) during cooling operation is not a very large value to minimize the amount of refrigerant in the refrigerant circuit. Hence, when the case where the degree of subcooling SC is controlled to be less than or equal to 10 degrees C. (0 degrees C. to 10 degrees C.) is considered, it is recommended that the quality $X_M$ of the medium-pressure two-phase refrigerant be a value ranging from 0.1310 to 0.3062 according to FIG. 7.

Next, the case where a refrigerant mixture of R32 and R1234yf is used as refrigerant will be discussed. R1234yf is tetrafluoropropene-based refrigerant represented by a chemical formula of $CF_3CF{=}CH_2$. First, a refrigerant mixture of R32 and R1234yf in a mixture ratio of 74 wt % to 26 wt % will be discussed. As illustrated in FIG. 7, when this case is considered in the same way as the above-described R32, it is recommended that the quality $X_M$ of medium-pressure two-phase refrigerant be a value ranging from 0.0791 to 0.3316. Furthermore, when the case where the degree of subcooling SC is controlled to be less than or equal to 10 degrees C. (0 degrees C. to 10 degrees C.) is considered, it is recommended that the quality $X_M$ of the medium-pressure two-phase refrigerant be a value ranging from 0.1529 to 0.3316.

Next, a refrigerant mixture of R32 and R1234yf in a mixture ratio of 44 wt % to 56 wt % will be discussed. As illustrated in FIG. 7, it is recommended that the quality $X_M$ of medium-pressure two-phase refrigerant be a value ranging from 0.1069 to 0.3585. Furthermore, when the case where the degree of subcooling SC is controlled to be less than or equal to 10 degrees C. (0 degrees C. to 10 degrees C.) is considered, it is recommended that the quality $X_M$ of the medium-pressure two-phase refrigerant be a value ranging from 0.1869 to 0.3585.

From the above-described results, as for R32 (single refrigerant) and a refrigerant mixture of R32 and R1234yf, a relationship of the quality $X_M$ to a mixture ratio of R32 is obtained by least squares approximation. The mixture ratio of R32 in the refrigerant mixture is assumed to be R (1/100 wt %) ($0 \leq R < 1$), it is recommended that the quality $X_M$ of medium-pressure two-phase refrigerant be a value ranging from $(-0.0782 \times R + 0.1399)$ to $(-0.0933 \times R + 0.3999)$. Furthermore, when the case where the degree of subcooling SC is controlled to be less than or equal to 10 degrees C. (0 degrees C. to 10 degrees C.) is considered, it is recommended that the quality of the medium-pressure two-phase refrigerant be a value ranging from $(-0.1002 \times R + 0.2297)$ to $(-0.0933 \times R + 0.3999)$.

It is noted that as tetrafluoropropene-based refrigerant, there is R1234ze in addition to R1234yf. R1234yf and R1234ze are not very different from each other in terms of physical property values, and thus the above-described relationship of the quality is applicable in the case where either refrigerant is used.

As described above, an appropriate quality of medium-pressure two-phase refrigerant to be fed into the extension pipe (on the two-phase side) 5*a* varies depending on the type of refrigerant used.

In the outdoor unit 1, there are provided the controller 50 and the liquid refrigerant temperature detection device 24 (an example of a medium pressure detection device). The liquid refrigerant temperature detection device 24 is provided at a location on an outlet side (downstream side) of the expansion device 14 in the cooling operation mode, and detects a saturation temperature at a medium pressure, which is a pressure of medium-pressure two-phase refrigerant throttled by the expansion device 14. It is difficult to measure a quality of refrigerant, and thus the quality of the medium-pressure two-phase refrigerant cannot be controlled directly. However, since the refrigerant undergoes an isenthalpic change in the expansion device 14, if the pressure (high pressure) and the temperature (a value obtained by subtracting a degree of subcooling from a condensing temperature) of the refrigerant at the inlet of the expansion device 14 are found, the pressure on the outlet side of the expansion device 14 is specified, and the quality can thereby be determined indirectly. Thus, an assumed high pressure and an assumed degree of subcooling are predetermined, and a range of a saturation temperature (for example, 10 degrees C. to 15 degrees C.) at a medium pressure corresponding to a range of the quality of the refrigerant in the extension pipe (on the two-phase side) 5*a* is obtained. The range of the saturation temperature at the medium pressure is assumed to be a control target range (control target values), the controller 50 controls the opening degree of the expansion device 14 so that a detected temperature of the liquid refrigerant temperature detection device 24 is within the control target range (that is, approaches a control target value). It is noted that, although a configuration can be achieved at a lower cost in which a saturation temperature at a medium pressure is measured by using a temperature sensor, a pressure sensor (another example of the medium pressure detection device) may be installed in place of the liquid refrigerant temperature detection device 24 so that the pressure (medium pressure) of medium-pressure refrigerant is detected. In this case, the opening degree of the expansion device 14 is controlled so that a detected pressure of the pressure sensor approaches a control target value of the medium pressure, and thus the quality of the refrigerant in the extension pipe (on the two-phase side) 5*a* is controlled.

Furthermore, the quality of the medium-pressure two-phase refrigerant varies depending on a setting value of a target medium pressure, the medium-pressure two-phase refrigerant is reduced in pressure by the expansion devices 16 in the respective indoor units 2, and thus the medium pressure has to be a value larger than pressures (low pressures) in the use side heat exchangers 17. A low pressure is changed by various factors, such as load conditions including temperatures of air-conditioned spaces (indoor spaces 7), the number of the indoor units 2 in operation, the total capacity of all the indoor units 2 connected to the outdoor unit 1, and an outdoor air temperature, which is an ambient temperature around the outdoor unit 1. Hence, it is recommended that the low pressure detection device 23 be provided on the suction side (upstream side) of the compressor 10, and a control target value of the medium pressure be set (changed) on the basis of a detected pressure (low pressure) of the low pressure detection device 23. That is, a control target value of a saturation temperature at the medium pressure is set to a value obtained by adding a predetermined temperature (for example, 5 degrees C.) to a saturation temperature at the low pressure. In the case where refrigerant is R32, for example, when the low pressure is 0.9515 MPa, the saturation temperature at the low pressure is 5 degrees C., and thus it is recommended that the control target value of the saturation temperature at the medium pressure be set to 10 degrees C. When the low pressure is 1.1069 MPa, the saturation temperature at the low pressure is 10 degrees C., and thus it is recommended that the control target value of the saturation temperature at the medium pressure be set to 15 degrees C.

Furthermore, even if medium pressures are the same, the qualities of medium-pressure two-phase refrigerant on the outlet side of the expansion device 14 are different when enthalpies at the condenser outlet (the inlet of the expansion device 14) are different. Thus, the high pressure detection device 22 may be provided on a discharge side (downstream side) of the compressor 10, and the liquid refrigerant temperature detection device 40 may be provided at a location on the downstream side of the heat source side heat exchanger 12 and on the upstream side of the expansion device 14 in the refrigerant flow direction during cooling operation (see FIG. 2). When a high pressure is detected by the high pressure detection device 22 and a high-pressure liquid temperature is detected by the liquid refrigerant temperature detection device 40, an enthalpy at the condenser outlet (the inlet of the expansion device 14) is determined by the high pressure and the high-pressure liquid temperature, and thus the quality of medium-pressure two-phase refrigerant at a medium pressure is determined. Hence, it is recommended that a control target value of the medium pressure be set (changed) on the basis of a detected pressure (high pressure) of the high pressure detection device 22 and a detected temperature (high-pressure liquid temperature) of the liquid refrigerant temperature detection device 24. That is, when a control target value of a saturation temperature at the medium pressure is set to a value varying depending on the high pressure and the high-pressure liquid refrigerant temperature, an appropriate quality can be more accurately set.

Furthermore, to reduce the amount of refrigerant in the refrigerant circuit as much as possible, it is desirable to increase the quality of the refrigerant in the extension pipe (on the two-phase side) 5*a*. Thus, when medium-pressure two-phase refrigerant having a value ranging from a middle value (the average of a lower limit and an upper limit) to the upper limit of each quality range described above is fed into the extension pipe (on the two-phase side) 5*a*, the effect of a reduction in the amount of refrigerant increases. That is, it is recommended that a control target value of a saturation temperature at the medium pressure be set so that the quality is within a range from the middle value to the upper limit of the quality range, and thus the expansion device 14 be controlled. Also, it is much recommended that the refrigerant having a closest possible value to the upper limit of the quality range described above be fed into the extension pipe (on the two-phase side) 5*a*.

Furthermore, since the medium-pressure two-phase refrigerant having a largest possible quality can reduce the amount of refrigerant, the description has been made here using assumed saturation temperatures of the medium-pressure two-phase refrigerant of 10 degrees C. and 15 degrees C. However, the medium-pressure two-phase refrigerant actually has to be reduced in pressure by the expansion devices 16, the extension pipe (on the two-phase side) 5*a* also has a pressure loss, and thus a largest possible saturation temperature, such as 30 degrees C., at the medium pressure enables stable operation. When the degree of subcooling at the condenser outlet is set to a small value and the medium pressure is set to a high value, the quality can be increased, and stable operation can be performed. In this case also, it is noted that the amount of refrigerant in the refrigerant circuit can be reduced by performing control so that the refrigerant in the extension pipe (on the two-phase side) 5*a* has a value equal to the quality described above.

Furthermore, in Embodiment 1, at the time of cooling operation, the two-phase refrigerant having flowed through the extension pipe (on the two-phase side) 5*a* is caused to flow into the expansion devices 16. Usually, when two-phase refrigerant is caused to flow into an expansion device, noise (refrigerant noise) is generated. Thus, as the expansion devices 16, a noise-reduction expansion device designed for noise (refrigerant noise caused by the two-phase refrigerant) to be less likely to be generated is used. An example of the noise-reduction expansion device is an expansion device or the like in which a foamed metal member (open-cell foam) is inserted on an upstream side with respect to a portion at which a refrigerant passage is narrowed, the two-phase refrigerant is stirred with the foamed metal member, and noise is thereby reduced.

[Heating Operation Mode]

Figure 8:
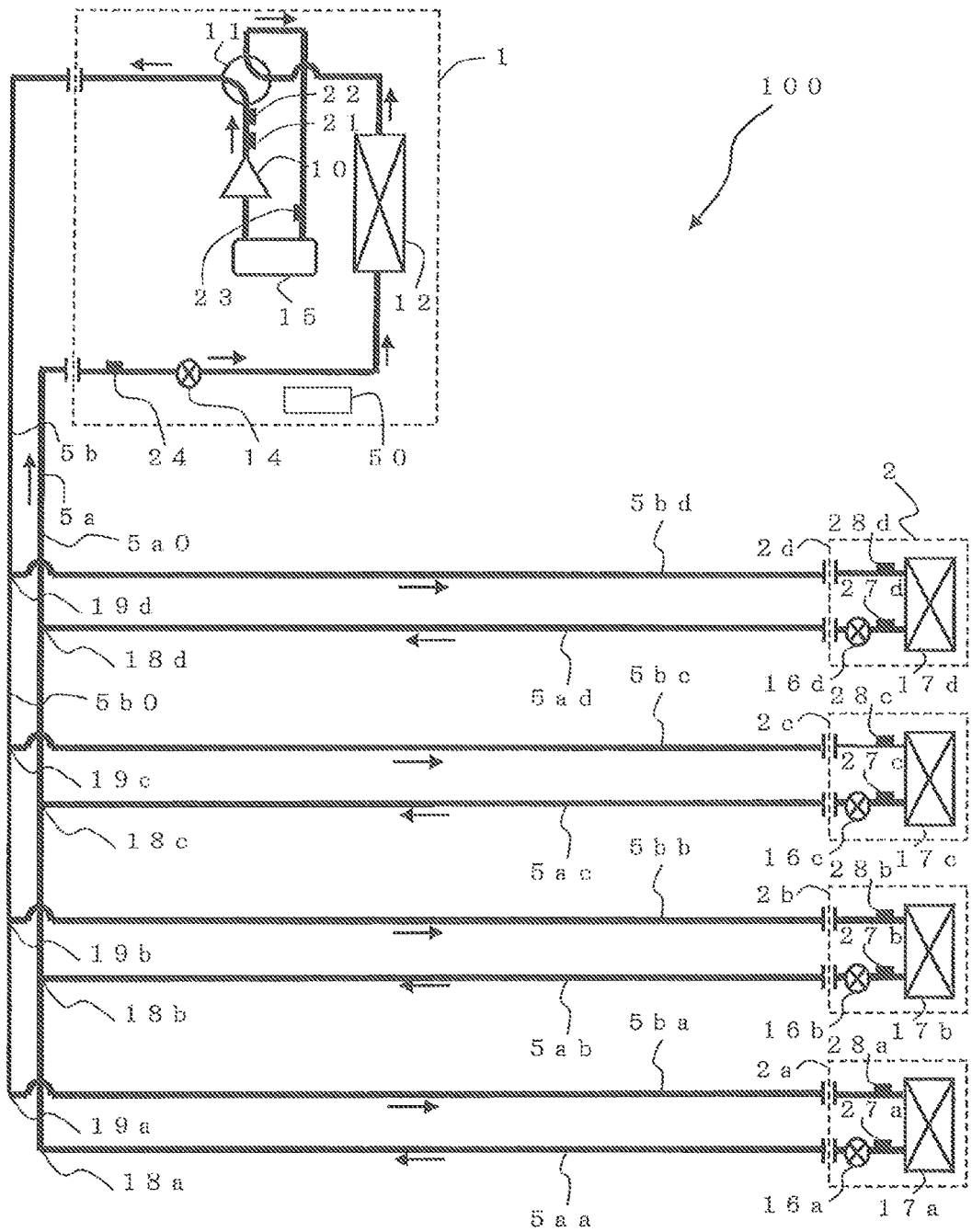
FIG. 8 is a circuit configuration diagram illustrating the flow of refrigerant in a heating operation mode of the air-conditioning apparatus according to Embodiment 1 of the present invention.

Next, a heating operation mode will be described. FIG. 8 is a circuit configuration diagram illustrating the flow of refrigerant in a heating operation mode of the air-conditioning apparatus 100. FIG. 8 illustrates the case where a heating energy load is generated in all the use side heat exchangers 17. It is noted that, in FIG. 8, pipes through which refrigerant flows are represented by thick lines and refrigerant flow directions are indicated by solid arrows.

In the case of the heating operation mode illustrated in FIG. 8, in the outdoor unit 1, the refrigerant flow switching device 11 is switched so that refrigerant discharged from the compressor 10 flows into the indoor units 2 without passing through the heat source side heat exchanger 12. Low-temperature, low-pressure refrigerant is compressed by the compressor 10 to turn into high-temperature, high-pressure gas refrigerant, and is discharged. The high-temperature, high-pressure gas refrigerant discharged from the compressor 10 passes through the refrigerant flow switching device 11, and flows out of the outdoor unit 1.

The high-temperature, high-pressure gas refrigerant having flowed out of the outdoor unit 1 flows into the main pipe 5*b*0 of the extension pipe (on the gas side) 5*b*. The high-temperature, high-pressure gas refrigerant having flowed into the main pipe 5*b*0 is divided by the junction units 19*a* to 19*d* to flow through the branch pipes 5*ba* to 5*bd*, and flows into the respective indoor units 2 (2*a* to 2*d*). The high-temperature, high-pressure gas refrigerant having flowed into the indoor units 2 flows into the respective use side heat exchangers 17 (17*a* to 17*d*) each operating as a condenser, and is condensed and liquefied by transferring heat to air sent to the use side heat exchangers 17. Thus, the high-temperature, high-pressure gas refrigerant turns into high-temperature, high-pressure liquid refrigerant, and also air to be blown into the indoor space 7 is heated. The high-temperature, high-pressure liquid refrigerant having flowed out of the use side heat exchangers 17 is expanded by the respective expansion devices 16 (16*a* to 16*d*) to turn into low-pressure two-phase refrigerant. At this time, opening degrees (opening areas) of the expansion devices 16*a* to 16*d* are controlled by the controllers of the respective indoor units 2 so that, for example, differences in temperature (degrees of subcooling) between condensing temperatures acquired from the controller 50 of the outdoor unit 1 through communications, and detected temperatures of the respective liquid refrigerant temperature detection devices 27 (27*a* to 27*d*) on the use side each approach a control target value. The low-pressure two-phase refrigerant expanded by the expansion devices 16 flows out of the indoor units 2.

The low-pressure two-phase refrigerant having flowed out of the indoor units 2 passes through the branch pipes 5*aa* to 5*ad*, the branch units 18*a* to 18*d*, and the main pipe 5*a*0, which are included in the extension pipe (on the two-phase side) 5*a*, and flows into the outdoor unit 1 again.

The low-pressure two-phase refrigerant having flowed into the outdoor unit 1 flows into the heat source side heat exchanger 12 via the expansion device 14 that is fully open. The low-pressure two-phase refrigerant having flowed into the heat source side heat exchanger 12 receives heat from outdoor air flowing around the heat source side heat exchanger 12, evaporates to turn into low-temperature, low-pressure gas refrigerant, and flows out of the heat source side heat exchanger 12. The low-temperature, low-pressure gas refrigerant having flowed out of the heat source side heat exchanger 12 passes through the refrigerant flow switching device 11, flows into the accumulator 15, and then is sucked into the compressor 10 again. It is noted that, because the expansion device 14 is fully open in the heating operation mode, a p-h diagram is the same as that in normal heating operation. Thus, a description of a refrigerant state using the p-h diagram is omitted.

In the implementation of the heating operation mode, refrigerant does not have to be fed into use side heat exchangers 17 having no heat load (including that in a thermostat-off state). However, in the heating operation mode, when the expansion device 16 corresponding to a use side heat exchanger 17 having no heating load is fully closed, or when an opening degree thereof is small to such an extent that the refrigerant does not flow, the refrigerant is cooled to be condensed by ambient air and stagnates in the use side heat exchanger 17 that is not operating, and the entire refrigerant circuit may suffer from a lack of refrigerant. Thus, in the heating operation mode, an opening degree (opening area) of the expansion device 16 corresponding to a use side heat exchanger 17 having no heat load is increased to a fully open level or the like, thereby preventing stagnation of refrigerant.

It is noted that the case has been described in which, in the heating operation mode, the refrigerant having flowed out of the condensers (use side heat exchangers 17) is reduced in pressure by the respective expansion devices 16 to turn into low-pressure two-phase state refrigerant, and is caused to flow through the extension pipe (on the two-phase side) 5*a*, and the expansion device 14 of the outdoor unit 1 is fully open. In heating operation, such operation is usually performed because the internal volume of the heat source side heat exchanger 12 is larger than the internal volume of the use side heat exchangers 17. In the case, or the like, where pipes constituting the heat source side heat exchanger 12 are subdivided, however, the internal volume of the use side heat exchangers 17 is larger than the internal volume of the heat source side heat exchanger 12 in some cases. In such a case, in the heating operation mode, the refrigerant having flowed out of the condensers may be reduced in pressure by the respective expansion devices 16 to turn into medium-pressure two-phase state refrigerant, be caused to flow through the extension pipe (on the two-phase side) 5*a*, be reduced in pressure by the expansion device 14 again to turn into low-pressure two-phase state refrigerant, and then be fed into the evaporator (heat source side heat exchanger 12). This allows the total amount of refrigerant present in each component in the refrigerant circuit during cooling operation to be almost the same as that during heating operation, and thus an accumulator to store excess refrigerant does not have to be included on the suction side of the compressor 10.

Furthermore, although a four-way valve is typically used as the refrigerant flow switching device 11, the refrigerant flow switching device 11 is not limited to this value. A plurality of two-way passage switching valves or three-way passage switching valves may be used so that passages can be switched as in the four-way valve.

Furthermore, although the case where the accumulator 15 to store excess refrigerant is provided on the suction side of the compressor 10 has been described here, an accumulator does not have to be provided if, for example, there is a little excess refrigerant.

Furthermore, although the case where the four indoor units 2 are connected has been described as an example, needless to say, no matter how many indoor units 2 are connected, the same things as those in the above description hold good.

Furthermore, the same also applies to the case where a plurality of outdoor units 1 are connected and refrigerant circuits of the plurality of outdoor units 1 are connected by pipes so that flows meet each other in the outside of the outdoor units 1, and the same things hold good.

Furthermore, although the case where a low-pressure shell-type compressor is used as the compressor 10 has been described as an example, a high-pressure shell-type compressor may be used as a matter of course, and produces the same effect.

As refrigerant, any refrigerant that operates in a subcritical state in a condenser and is liquid refrigerant on an outlet side of the condenser may be used, and produces the same effect. Examples of the refrigerant include single refrigerant, such as R-22, R-134a, and R-32, a near-azeotropic refrigerant mixture, such as R-410A and R-404A, a non-azeotropic refrigerant mixture, such as R-407C, tetrafluoropropene-based refrigerant (such as R1234yf and R1234ze) whose global warming potential is small and that is represented by a chemical formula of $CF_3CF{=}CH_2$, natural refrigerant, such as propane, and a refrigerant mixture containing any component of these refrigerants. Furthermore, as for refrigerant, such as $CO_2$ refrigerant and a refrigerant mixture containing $CO_2$, that comes into a supercritical state on a high-pressure side, a reduction in pressure increases the density in some cases, and thus simply putting the refrigerant into a medium-pressure two-phase state does not necessarily reduce the amount of the refrigerant in the extension pipe (on the two-phase side) 5*a*. However, as for the refrigerant that comes into a supercritical state on a high-pressure side, a difference in pressure between high pressure and low pressure is large, and a medium pressure can therefore be set to a low value. If, as in the refrigerant in a subcritical state, the medium pressure is controlled so that the density of the medium-pressure two-phase refrigerant is smaller than the density of the refrigerant at an outlet of a heat exchanger (gas cooler) on the high-pressure side, the same effect can be obtained.

Furthermore, although a fan is typically installed in the heat source side heat exchanger 12 and the use side heat exchangers 17*a* to 17*d*, and speeds up condensation or evaporation by sending air in many cases, the configuration is not limited to this. For example, as the use side heat exchangers 17*a* to 17*d*, something like a panel heater utilizing radiation can also be used, and, as the heat source side heat exchanger 12, a water-cooled-type heat exchanger that transfers heat by using water or an antifreeze solution can also be used. That is, as the heat source side heat exchanger 12 and the use side heat exchangers 17*a* to 17*d*, any heat exchangers that each can transfer heat or receive heat can be used.

Furthermore, although the cooling/heating switching-type direct-expansion air-conditioning apparatus that allows refrigerant to circulate between the outdoor unit 1 and the indoor units 2 has been described as an example here, the air-conditioning apparatus is not limited to this. Embodiment 1 is also applicable to a direct-expansion air-conditioning apparatus capable of performing cooling and heating mixed operation. In the direct-expansion air-conditioning apparatus capable of performing cooling and heating mixed operation, refrigerant circulates between the outdoor unit 1 and the indoor units 2 via a relay device, and cooling or heating can be selected for each indoor unit 2. In the air-conditioning apparatus capable of performing cooling and heating mixed operation, in a cooling only operation mode in which all the indoor units 2 perform cooling operation (including stopping), if refrigerant having flowed out of a condenser is reduced in pressure by an expansion device of the outdoor unit 1 so that medium-pressure two-phase refrigerant is fed into an extension pipe, the same effect can be obtained. It is noted that, since cooling and heating mixed operation has to be performed in this type of air-conditioning apparatus, as an extension pipe through which high-pressure refrigerant flows in the cooling only operation mode, a pipe thicker than that in the cooling/heating switching-type air-conditioning apparatus is used. Hence, in the air-conditioning apparatus capable of performing cooling and heating mixed operation, the medium-pressure two-phase refrigerant is fed into the extension pipe, and a larger amount of refrigerant can thereby be reduced than that in the cooling/heating switching-type air-conditioning apparatus. Additionally, in this type of air-conditioning apparatus, the outdoor unit 1 and the relay device are connected with a main pipe (part of the extension pipe), and the relay device and the indoor units 2 are connected with branch pipes (part of the extension pipe). In this case, the refrigerant from the main pipe is divided in the relay device to flow through the branch pipes. As for branch units in the relay device also, the branch units 18 of the same structure as those in the cooling/heating switching-type air-conditioning apparatus are used, and the medium-pressure two-phase refrigerant in the cooling only operation mode can thereby be distributed into the branch pipes while the refrigerant remains in the two-phase state.

Furthermore, in the cooling/heating switching-type air-conditioning apparatus, in cooling operation, high-pressure liquid refrigerant having flowed out of the condenser (heat source side heat exchanger 12) is reduced in pressure by the expansion device 14 to turn into medium-pressure two-phase refrigerant, flows out of the outdoor unit 1, and flows through the extension pipe (on the two-phase side) 5*a*. The medium-pressure two-phase refrigerant having flowed into the indoor units 2 via the extension pipe (on the two-phase side) 5*a* is further reduced in pressure by the respective expansion devices 16 to turn into low-pressure two-phase refrigerant, turns into low-pressure gas refrigerant in the respective evaporators (use side heat exchangers 17), and flows out of the respective indoor units 2. The low-pressure gas refrigerant having flowed out of the indoor units 2 flows through the extension pipe (on the gas side) 5*b*, and flows into the outdoor unit 1. In heating operation, high-pressure gas refrigerant discharged from the compressor 10 flows out of the outdoor unit 1, and flows through the extension pipe (on the gas side) 5*b*. The high-pressure gas refrigerant having flowed into the indoor units 2 via the extension pipe (on the gas side) 5*b* turns into high-pressure liquid refrigerant in the respective condensers (use side heat exchangers 17), is reduced in pressure by the respective expansion devices 16 to turn into medium-pressure or low-pressure two-phase refrigerant, flows out of the respective indoor units 2, and flows through the extension pipe (on the two-phase side) 5*a*. The medium-pressure or low-pressure two-phase refrigerant having flowed into the outdoor unit 1 via the extension pipe (on the two-phase side) 5*a* flows into the evaporator (heat source side heat exchanger 12) via the expansion device 14.

On the other hand, in the air-conditioning apparatus capable of performing cooling and heating mixed operation, in cooling operation, high-pressure liquid refrigerant having flowed out of the condenser (heat source side heat exchanger 12) is reduced in pressure by the expansion device 14 to turn into medium-pressure two-phase refrigerant, flows out of the outdoor unit 1, and flows through the extension pipe (on the two-phase side) 5*a*. The medium-pressure two-phase refrigerant having flowed into the indoor units 2 via the extension pipe (on the two-phase side) 5*a* is further reduced in pressure by the respective expansion devices 16 to turn into low-pressure two-phase refrigerant, turns into low-pressure gas refrigerant in the respective evaporators (use side heat exchangers 17), and flows out of the respective indoor units 2. The low-pressure gas refrigerant having flowed out of the indoor units 2 flows through the extension pipe (on the gas side) 5*b*, and flows into the outdoor unit 1. In heating operation, high-pressure gas refrigerant discharged from the compressor 10 flows out of the outdoor unit 1, and flows through the extension pipe (on the two-phase side) 5*a*. The high-pressure gas refrigerant having flowed into the indoor units 2 via the extension pipe (on the two-phase side) 5*a* turns into high-pressure liquid refrigerant in the respective condensers (use side heat exchangers 17), is reduced in pressure by the respective expansion devices 16 to turn into medium-pressure or low-pressure two-phase refrigerant, flows out of the respective indoor units 2, and flows through the extension pipe (on the gas side) 5*b*. The medium-pressure or low-pressure two-phase refrigerant having flowed into the outdoor unit 1 via the extension pipe (on the gas side) 5*b* flows into the evaporator (heat source side heat exchanger 12) via the expansion device 14.

Figure 9:
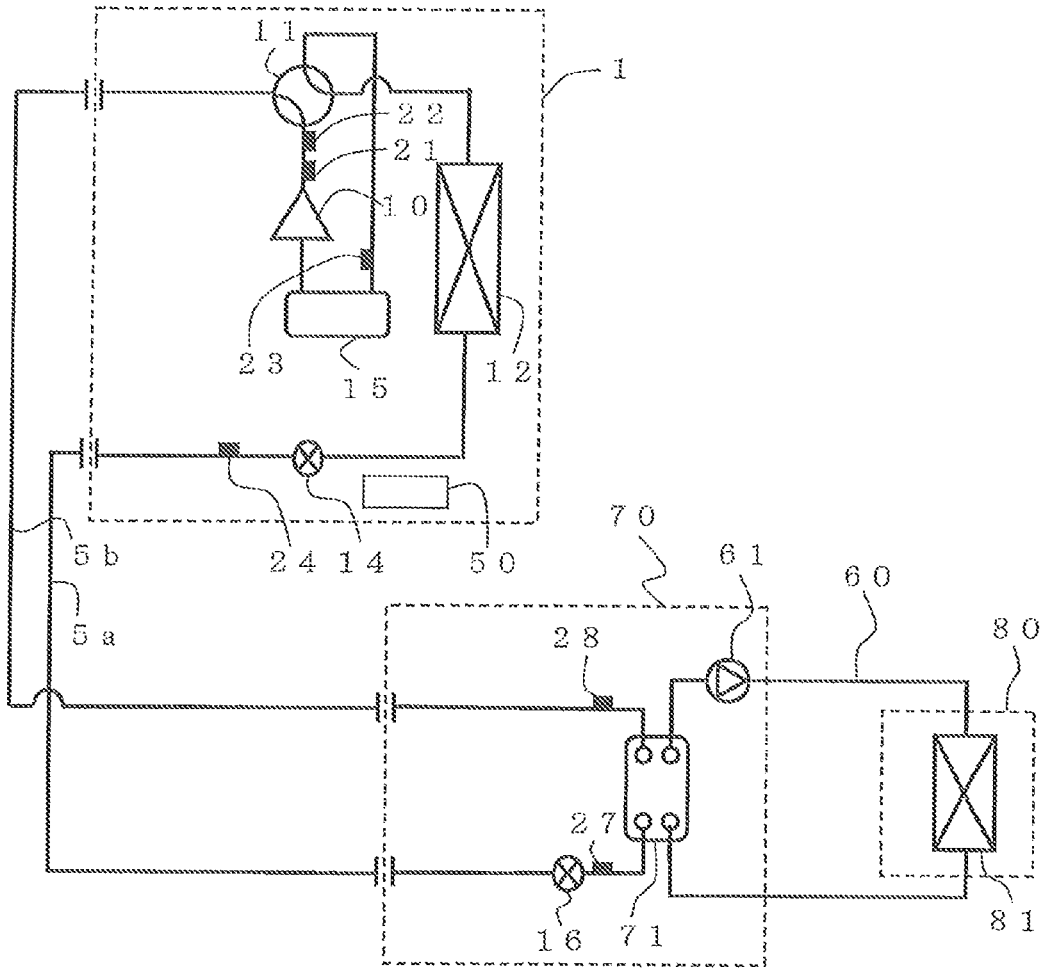
FIG. 9 is a schematic circuit configuration diagram illustrating another example of the circuit configuration of the air-conditioning apparatus according to Embodiment 1 of the present invention.

Furthermore, Embodiment 1 is also applicable to a refrigerant-heat medium relay-type air-conditioning apparatus. FIG. 9 is a schematic circuit configuration diagram illustrating, as another example of the circuit configuration of the air-conditioning apparatus according to Embodiment 1, a circuit configuration of an air-conditioning apparatus that is of a refrigerant-heat medium relay type and a cooling/heating switching type. As illustrated in FIG. 9, the refrigerant-heat medium relay-type air-conditioning apparatus includes a refrigerant circuit through which refrigerant circulates, and also includes a heat medium circuit 60 through which a heat medium (for example, water, brine, or the like) circulates, and a relay device 70 (an example of a casing) interposed between the refrigerant circuit and the heat medium circuit 60. In this configuration, the refrigerant circuit connects the outdoor unit 1 with the relay device 70. The relay device 70 houses an expansion device 16, a refrigerant-heat medium heat exchanger 71 (an example of a second heat exchanger), a pump 61 for the heat medium circuit 60, and other components. In the refrigerant-heat medium heat exchanger 71, heat exchanges between the refrigerant circulating through the refrigerant circuit and the heat medium circulating through the heat medium circuit 60. The heat medium circuit 60 connects the relay device 70 with an indoor unit 80. In the heat medium circuit 60, there are provided the refrigerant-heat medium heat exchanger 71, the pump 61 to cause the heat medium to circulate, a use side heat exchanger 81 housed in the indoor unit 80, and other components. The use side heat exchanger 81 exchanges heat between the heat medium flowing through the inside thereof and air supplied from a fan, which is not illustrated, and generates cooling air or heating air to be supplied to the indoor space 7. In the refrigerant-heat medium relay-type air-conditioning apparatus illustrated in FIG. 9, cooling energy or heating energy generated in the outdoor unit 1 is conveyed to the indoor unit 80 via the refrigerant circuit, the relay device 70, and the heat medium circuit 60. The flows of refrigerant in cooling operation and heating operation are the same as the flows of refrigerant described with reference to FIG. 3, FIG. 8, and the like, and thus descriptions thereof are omitted.

Figure 10:
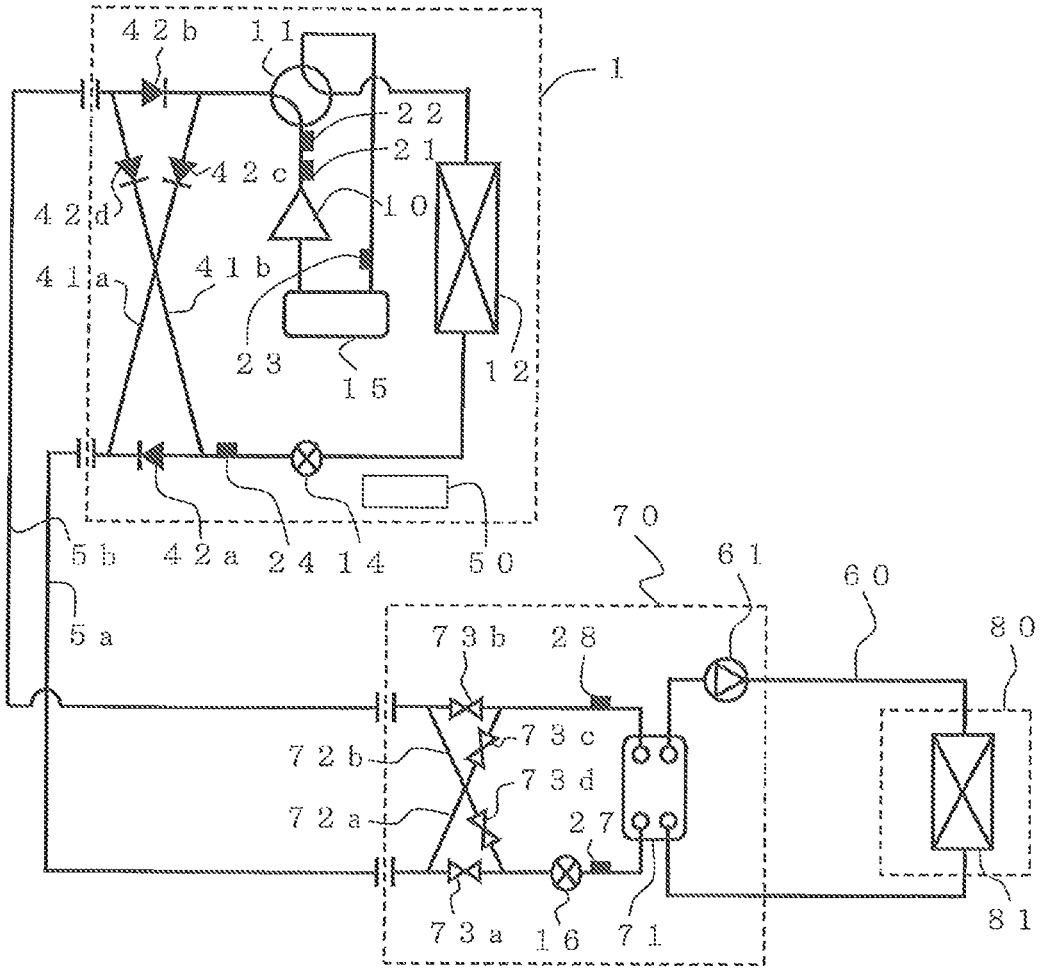
FIG. 10 is a schematic circuit configuration diagram illustrating still another example of the circuit configuration of the air-conditioning apparatus according to Embodiment 1 of the present invention.

FIG. 10 is a schematic circuit configuration diagram illustrating still another example of the circuit configuration of the air-conditioning apparatus according to Embodiment 1. In the outdoor unit 1 of a refrigerant-heat medium relay-type air-conditioning apparatus illustrated in FIG. 10, there are provided connection pipes 41*a* and 41*b*, and check valves 42*a*, 42*b*, 42*c*, and 42*d*. The check valve 42*a* is provided in a refrigerant pipe between the expansion device 14 and the extension pipe 5*a*, and permits refrigerant to flow only in a direction from the expansion device 14 to the extension pipe 5*a*. The check valve 42*b* is provided in a refrigerant pipe between the extension pipe 5*b* and the refrigerant flow switching device 11, and permits refrigerant to flow only in a direction from the extension pipe 5*b* to the refrigerant flow switching device 11. The connection pipe 41*a* and the check valve 42*c* provided in the connection pipe 41*a* cause high-pressure gas refrigerant discharged from the compressor 10 during heating operation to flow into the extension pipe 5*a*. The connection pipe 41*b* and the check valve 42*d* provided in the connection pipe 41*b* cause medium-pressure or low-pressure two-phase refrigerant having flowed thereinto from the extension pipe 5*b* during heating operation to flow to the suction side of the compressor 10 via the expansion device 14 and the heat source side heat exchanger 12. In the outdoor unit 1, the connection pipe 41*a* connects a refrigerant pipe between the refrigerant flow switching device 11 and the check valve 42*b* with a refrigerant pipe between the check valve 42*a* and the extension pipe 5*a*. In the outdoor unit 1, the connection pipe 41*b* connects a refrigerant pipe between the check valve 42*b* and the extension pipe 5*b* with a refrigerant pipe between the expansion device 14 and the check valve 42*a*.

Furthermore, in the relay device 70, there are provided connection pipes 72*a* and 72*b*, and on-off valves 73*a*, 73*b*, 73*c*, and 73*d*. The on-off valve 73*a* is provided in a refrigerant pipe between the extension pipe 5*a* and the expansion device 16. The on-off valve 73*b* is provided in a refrigerant pipe between the refrigerant-heat medium heat exchanger 71 and the extension pipe 5*b*. The connection pipe 72*a* connects a refrigerant pipe between the extension pipe 5*a* and the on-off valve 73*a* with a refrigerant pipe between the refrigerant-heat medium heat exchanger 71 and the on-off valve 73*b*. The on-off valve 73*c* is provided in the connection pipe 72*a*. The connection pipe 72*b* connects a refrigerant pipe between the on-off valve 73*a* and the expansion device 16*d* with a refrigerant pipe between the on-off valve 73*b* and the extension pipe 5*b*. The on-off valve 73*d* is provided in the connection pipe 72*b*.

At the time of cooling operation, control is performed so that the on-off valves 73*a* and 73*b* are in an open state and the on-off valves 73*c* and 73*d* are in a closed state. Thus, at the time of cooling operation, medium-pressure two-phase refrigerant whose pressure has been reduced by the expansion device 14 passes through the check valve 42*a*, the extension pipe 5*a*, and the on-off valve 73*a*, and flows into the expansion device 16. Furthermore, low-pressure gas refrigerant having flowed out of the refrigerant-heat medium heat exchanger 71 passes through the on-off valve 73*b*, the extension pipe 5*b*, the check valve 42*b*, and the refrigerant flow switching device 11, and is sucked into the compressor 10. That is, in the air-conditioning apparatus illustrated in FIG. 10, in cooling operation, the medium-pressure two-phase refrigerant is caused to flow through the extension pipe 5*a*, and the low-pressure gas refrigerant is caused to flow through the extension pipe 5*b*.

At the time of heating operation, control is performed so that the on-off valves 73*a* and 73*b* are in a closed state and the on-off valves 73*c* and 73*d* are in an open state. Thus, at the time of heating operation, high-pressure gas refrigerant discharged from the compressor 10 passes through the refrigerant flow switching device 11, the connection pipe 41*a* (check valve 42*c*), the extension pipe 5*a*, and the connection pipe 72*a* (on-off valve 73*c*), and flows into the refrigerant-heat medium heat exchanger 71. Furthermore, medium-pressure or low-pressure two-phase refrigerant whose pressure has been reduced by the expansion device 16 passes through the connection pipe 72*b* (on-off valve 73*d*), the extension pipe 5*b*, and the connection pipe 41*b* (check valve 42*d*), and flows into the expansion device 14. That is, in the air-conditioning apparatus illustrated in FIG. 10, in heating operation, the high-pressure gas refrigerant is caused to flow through the extension pipe 5*a*, and the medium-pressure or low-pressure two-phase refrigerant is caused to flow through the extension pipe 5*b*.

It is noted that, although FIG. 9 and FIG. 10 each illustrate the configuration in which one indoor unit 80 is connected, a plurality of indoor units 80 (a plurality of use side heat exchangers 81) may be connected in parallel with the heat medium circuit 60 as a matter of course. Additionally, in a heat medium passage in each indoor unit 80, a flow control valve to control the flow rate of a heat medium flowing through the use side heat exchanger 81 may be provided. Furthermore, a plurality of refrigerant-heat medium heat exchangers 71 may be provided. In the configuration in FIG. 10, if a plurality of refrigerant-heat medium heat exchangers 71 are provided, a refrigerant-heat medium relay-type air-conditioning apparatus capable of performing cooling and heating mixed operation can be provided.

In refrigerant-heat medium relay-type air-conditioning apparatuses also, as for a refrigerant-heat medium relay-type air-conditioning apparatus capable of performing cooling and heating mixed operation, as an extension pipe through which high-pressure refrigerant flows in the cooling only operation mode, a pipe thicker than that in the cooling/heating switching-type air-conditioning apparatus is used. Hence, medium-pressure two-phase refrigerant is fed into the extension pipe, and a large amount of refrigerant can thereby be reduced. In addition, in this type of air-conditioning apparatus, the outdoor unit 1 and the relay device 70 are connected with the extension pipes 5*a* and 5*b* through which refrigerant flows, and the relay device 70 and the indoor units 80 are connected with other extension pipes through which a heat medium flows. Thus, in the cooling operation mode, refrigerant on the outlet side of the outdoor unit 1 is reduced in pressure by the expansion device 14 to turn into medium-pressure two-phase refrigerant, thereby enabling a reduction in the amount of refrigerant in the extension pipe 5*a* connecting the outdoor unit 1 with the relay device 70. Additionally, in the case where the medium-pressure two-phase refrigerant has to be divided in the relay device 70, the branch unit 18 of the above-described structure is used, and the two-phase refrigerant can thereby be distributed while the refrigerant remains in the two-phase state. Furthermore, in the refrigerant-heat medium relay-type air-conditioning apparatus, the states of refrigerant flowing through the extension pipe (on the two-phase side) 5*a* and the extension pipe (on the gas side) 5*b* during cooling operation and during heating operation are the same as those in the air-conditioning apparatus capable of performing cooling and heating mixed operation.

Furthermore, in the air-conditioning apparatus capable of performing cooling and heating mixed operation, a two-pipe type in which the outdoor unit 1 and the indoor units 2 (or the relay device) are connected with two extension pipes (refrigerant pipes) or a three-pipe type in which the outdoor unit 1 and the indoor units 2 (or the relay device) are connected with three extension pipes (refrigerant pipes) may be employed. The same applies both to a direct-expansion type in which refrigerant flows to the indoor units 2 and to a refrigerant-heat medium relay type in which a heat medium flows from the relay device to the indoor units 2. Both in the two-pipe type and in the three-pipe type, in cooling operation, the expansion device 14 that reduces the pressure of refrigerant having flowed out of the condenser (heat source side heat exchanger 12) to put the refrigerant into a medium-pressure two-phase state is installed in the outdoor unit 1, and, among a plurality of (two or three) extension pipes, medium-pressure two-phase refrigerant is fed into an extension pipe through which the refrigerant having flowed out of the condenser flows to the indoor units 2 (or the relay device). This can reduce the amount of refrigerant in the extension pipe, thereby enabling a reduction in the amount of refrigerant in the entire refrigerant circuit.

As described above, the air-conditioning apparatus according to Embodiment 1 includes the refrigerant circuit connecting, by the refrigerant pipe, the compressor 10, the heat source side heat exchanger 12, the expansion devices 16*a* to 16*d*, and the use side heat exchangers 17*a* to 17*d*, and circulating refrigerant therein. The compressor 10 and the heat source side heat exchanger 12 are housed in the outdoor unit 1, the expansion devices 16*a* to 16*d* and the use side heat exchangers 17*a* to 17*d* are housed in casings (for example, the indoor units 2*a* to 2*d*) installed at locations away from the outdoor unit 1, the outdoor unit 1 and the casings are connected via a plurality of extension pipes 5*a* and 5*b* constituting a part of the refrigerant pipe, the refrigerant circuit enables cooling operation in which the heat source side heat exchanger 12 operates as a condenser and all of the use side heat exchangers 17*a* to 17*d* in a non-stopped state each operate as an evaporator, the outdoor unit 1 houses the expansion device 14 provided at a location on a downstream side with respect to the heat source side heat exchanger 12 and on an upstream side with respect to the expansion devices 16*a* to 16*d* in a refrigerant flow direction in the cooling operation, and the expansion device 14 and the expansion devices 16*a* to 16*d* are connected via the extension pipe 5*a*, which is one of the extension pipes 5*a* and 5*b*. The expansion device 14 reduces a pressure of refrigerant that is to flow into the extension pipe 5*a* in the cooling operation to cause the refrigerant to turn into refrigerant having a medium pressure and in a two-phase state, and the medium pressure is lower than a refrigerant pressure in the heat source side heat exchanger 12 (condenser) and higher than refrigerant pressures in the use side heat exchangers 17*a* to 17*d* (evaporator). In the cooling operation, the refrigerant having the medium pressure and in the two-phase state is caused to flow through the extension pipe 5*a*.

According to this configuration, the refrigerant that is to flow into the extension pipe 5*a* is reduced in pressure by the expansion device 14 so that the refrigerant is put into a two-phase state, thereby enabling a reduction in the density of the refrigerant in the extension pipe 5*a* and a reduction in the amount of the refrigerant in the extension pipe 5*a*. Thus, the amount of refrigerant in the entire refrigerant circuit can be reduced. Furthermore, since the amount of refrigerant in the refrigerant circuit can be reduced, in the unlikely event of refrigerant leakage, the environmental impact can be reduced.

Furthermore, in the air-conditioning apparatus according to Embodiment 1, a plurality of expansion devices 16*a* to 16*d* and a plurality of use side heat exchangers 17*a* to 17*d* are provided, the casings are a plurality of indoor units 2*a* to 2*d* each configured to supply cooling air or heating air to an indoor space, the expansion devices 16*a* to 16*d* and the use side heat exchangers 17*a* to 17*d* are housed in the respective indoor units 2*a* to 2*d*, and the extension pipe 5*a* includes the main pipe 5*a*0 connected to the outdoor unit 1 and a plurality of branch pipes 5*aa* to 5*ad* connected to the respective indoor units 2*a* to 2*d*. In the cooling operation, medium-pressure two-phase state refrigerant having flowed out of the outdoor unit 1 is caused to circulate from the outdoor unit 1 to the indoor units 2*a* to 2*d*, the refrigerant evaporates, and then the refrigerant is caused to flow back to the outdoor unit 1.

According to this configuration, in a direct-expansion-type air-conditioning apparatus, the amount of refrigerant in a refrigerant circuit can be reduced.

Furthermore, the air-conditioning apparatus according to Embodiment 1 further includes the heat medium circuit 60 in which a heat medium that is to exchange heat with refrigerant in the refrigerant-heat medium heat exchanger 71 circulates. A casing is the relay device 70 interposed between the refrigerant circuit and the heat medium circuit 60. In the cooling operation, medium-pressure two-phase state refrigerant having flowed out of the outdoor unit 1 is caused to circulate from the outdoor unit 1 to the relay device 70, the refrigerant evaporates, and then the refrigerant is caused to flow back to the outdoor unit 1.

According to this configuration, in a refrigerant-heat medium relay-type air-conditioning apparatus, the amount of refrigerant in a refrigerant circuit can be reduced.

The above-described configurations in Embodiment 1 and modifications can be combined with each other and implemented.

REFERENCE SIGNS LIST outdoor unit 2, 2*a*, 2*b*, 2*c*, 2*d* indoor unit 5, 5*a*, 5*b* extension pipe

5*a*0, 5*b*0 main pipe 5*aa*, 5*ab*, 5*ac*, 5*ad*, 5*ba*, 5*bb*, 5*bc*, 5*bd* branch pipe

6 outdoor space 7 indoor space 9 building 10 compressor 11 refrigerant flow switching device 12 heat source side heat exchanger 14 expansion device 15 accumulator 16, 16*a*, 16*b*, 16*c*, 16*d* expansion device

17, 17*a*, 17*b*, 17*c*, 17*d* use side heat exchanger 18, 18*a*, 18*b*, 18*c*, 18*d* branch unit 19*a*, 19*b*, 19*c*, 19*d* junction unit 21 discharge refrigerant temperature detection device 22 high pressure detection device 23 low pressure detection device 24 liquid refrigerant temperature detection device

27, 27*a*, 27*b*, 27*c*, 27*d* liquid refrigerant temperature detection device

28, 28*a*, 28*b*, 28*c*, 28*d* gas refrigerant temperature detection device 30 inlet 31, 32 outlet 40 liquid refrigerant temperature detection device 41*a*, 41*b* connection pipe 42*a*, 42*b*, 42*c*, 42*d* check valve 50 controller 60 heat medium circuit 61 pump 70 relay device 71 refrigerant-heat medium heat exchanger 72*a*, 72*b* connection pipe 73*a*, 73*b*, 73*c*, 73*d* on-off valve 80 indoor unit 81 use side heat exchanger 100 air-conditioning apparatus

The invention claimed is:

1. An air-conditioning apparatus comprising a refrigerant circuit connecting, by a refrigerant pipe, a compressor, a first heat exchanger, at least one first expansion device, and at least one second heat exchanger, the refrigerant circuit circulating refrigerant therein, the compressor and the first heat exchanger being housed in a heat source unit, the at least one first expansion device and the at least one second heat exchanger being housed in at least one casing installed at a location away from the heat source unit, the heat source unit and the at least one casing being connected via a plurality of extension pipes constituting a part of the refrigerant pipe, the refrigerant circuit enabling cooling operation in which the first heat exchanger operates as a condenser and the at least one second heat exchanger in a non-stopped state operates as an evaporator, the heat source unit housing a second expansion device provided at a second location on a downstream side with respect to the first heat exchanger and on an upstream side with respect to the at least one first expansion device in a refrigerant flow direction in the cooling operation, the second expansion device and the at least one first expansion device being connected via a first extension pipe being one of the plurality of extension pipes, the second expansion device reducing a pressure of refrigerant flowing into the first extension pipe in the cooling operation to cause the refrigerant to turn into refrigerant having a medium pressure and in a two-phase state, the medium pressure being lower than a refrigerant pressure in the first heat exchanger and higher than a refrigerant pressure in the second heat exchanger operating as the evaporator, in the cooling operation, the refrigerant having the medium pressure and in the two-phase state being caused to flow through the first extension pipe, a refrigerant mixture of R32 and tetrafluoropropene-based refrigerant being used as the refrigerant, when a mixture ratio of R32 in the refrigerant mixture is R (1/100 wt %), in the cooling operation, a quality of refrigerant to be caused to flow through the first extension pipe being a value within a quality range from $(-0.0782\times R+0.1399)$ to $(-0.0933\times R+0.3999)$, wherein the air-conditioning apparatus further comprises:

a detection device provided on a downstream side of the second expansion device in the refrigerant flow direction in the cooling operation, and detecting a pressure or a saturation temperature of refrigerant;

a controller configured to control an opening degree of the second expansion device based on a detected pressure or a detected temperature of the detection device; and a low pressure detection device provided on a suction side of the compressor, and detecting a pressure of refrigerant, wherein the controller is configured to change a control target value of a pressure or a saturation temperature of the refrigerant having the medium pressure and in the two-phase state based on a detected pressure of the low pressure detection device, and control the opening degree of the second expansion device so that the detected pressure or the detected temperature of the detection device approaches the control target value that is changed.

2. The air-conditioning apparatus of claim 1, wherein the at least one first expansion device comprises a plurality of first expansion devices and the at least one second heat exchanger comprises a plurality of second heat exchangers, wherein the at least one casing comprises a plurality of indoor units each configured to supply cooling air or heating air to an indoor space, wherein each one of the plurality of first expansion devices and each one of the plurality of second heat exchangers are housed in each one of the plurality of indoor units, wherein the first extension pipe includes a main pipe connected to the heat source unit and a plurality of branch pipes each connected to each one of the plurality of indoor units, and wherein, in the cooling operation, the refrigerant having the medium pressure and in the two-phase state flowed out of the heat source unit is caused to flow from the heat source unit to the plurality of indoor units, the refrigerant is evaporated, and then the refrigerant is caused to flow back to the heat source unit.

3. The air-conditioning apparatus of claim 1, further comprising a heat medium circuit circulating a heat medium exchanging heat with refrigerant in the at least one second heat exchanger, wherein the at least one casing is a relay device interposed between the refrigerant circuit and the heat medium circuit, and wherein, in the cooling operation, the refrigerant having the medium pressure and in the two-phase state flowed out of the heat source unit is caused to flow from the heat source unit to the relay device, the refrigerant is evaporated, and then the refrigerant is caused to flow back to the heat source unit.

4. The air-conditioning apparatus of claim 1, wherein the first extension pipe includes a main pipe connected to the heat source unit, a branch pipe connecting the main pipe with the at least one casing, and a branch unit separating the branch pipe from the main pipe, and wherein the branch unit is configured to, in the cooling operation, divide two-phase state refrigerant flowing through the main pipe to cause part of the two-phase state refrigerant to flow into the branch pipe while the part remains in the two-phase state.

5. The air-conditioning apparatus of claim 4, wherein the branch unit has a Y-shaped or T-shaped joint structure, and wherein the branch unit is installed so that refrigerant flowing upward from below or downward from above in the refrigerant flow direction in the cooling operation is divided to flow in substantially rightward and leftward directions.

6. The air-conditioning apparatus of claim 1, wherein the at least one second heat exchanger comprises a plurality of second heat exchangers, wherein the refrigerant circuit enables heating operation in which the first heat exchanger operates as an evaporator and all of the plurality of second heat exchangers in a non-stopped state each operate as a condenser, wherein the at least one first expansion device reduces a pressure of refrigerant flowing into the first extension pipe in the heating operation to cause the refrigerant to turn into refrigerant having the medium pressure or a low pressure and in the two-phase state, and the low pressure is a refrigerant pressure in the evaporator, and wherein, in the heating operation, the refrigerant having the medium pressure or the low pressure and in the two-phase state is caused to flow through the first extension pipe.

7. The air-conditioning apparatus of claim 1, wherein the refrigerant circuit enables heating operation in which the first heat exchanger operates as an evaporator and the at least one second heat exchanger in a non-stopped state operates as a condenser, wherein, in the heating operation, the at least one first expansion device and the second expansion device are connected via a second extension pipe being different from the first extension pipe of the plurality of extension pipes, wherein the at least one first expansion device reduces a pressure of refrigerant flowing into the second extension pipe in the heating operation to cause the refrigerant to turn into refrigerant having the medium pressure or a low pressure and in the two-phase state, and the low pressure is a refrigerant pressure in the evaporator, and wherein, in the heating operation, the refrigerant having the medium pressure or the low pressure and in the two-phase state is caused to flow through the second extension pipe.

8. The air-conditioning apparatus of claim 1, wherein, when a degree of subcooling is controlled to be less than or equal to 10 degrees C., the quality is a value within a quality range from $(-0.1002\times R+0.2297)$ to $(-0.0933\times R+0.3999)$.

9. The air-conditioning apparatus of claim 1, wherein the quality is a value ranging from a middle value to an upper limit of the quality range.

* * * * *